United States Patent [19]

Iwasaka et al.

[11] 3,999,631

[45] Dec. 28, 1976

[54] ELEVATOR CONTROL SYSTEM

[75] Inventors: Tatsuo Iwasaka; Takeo Yuminaka; Takashi Kaneko; Hiroshi Kinoshita, all of Katsuta; Yukio Kawamoto, Hitachi, all of Japan

[73] Assignee: Hitachi, Ltd., Japan

[22] Filed: Mar. 21, 1975

[21] Appl. No.: 560,801

[30] Foreign Application Priority Data

Mar. 25, 1974 Japan ..... 49-32575

[52] U.S. Cl. ..... 187/29 R

[51] Int. Cl.[2] ..... B66B 1/18

[58] Field of Search ..... 187/29

[56] References Cited

UNITED STATES PATENTS

| | | | |
|---|---|---|---|
| 3,511,342 | 5/1970 | Hall et al. | 187/29 |
| 3,682,275 | 8/1972 | Loshbough et al. | 187/29 |
| 3,746,131 | 7/1973 | Hirasawa et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

In an elevator control system comprising a plurality of cars serving a plurality of floors, hall call register means provided on the landing of each floor, cage call register means provided in each car, and means for detecting the number of passenger in each car;

the improvement comprising means for forecasting the number of in-cage passengers for every destination floor by allotting the detected number of in-cage passengers to the cage calls, means for detecting the number of waiting passengers provided on the landing of specified floors, means for setting the number of waiting passengers on other than the landing of the specified floors, means for sequentially adding the detected number of prospective passengers waiting on each of the specified floors that have generated the hall calls to the detected number of in-cage passengers, means for sequentially adding the setting of the number of waiting passengers on each of the floors other than the specified floors that have generated the hall calls to the number of detected passengers, means for subtracting the number of forecast in-cage passengers for every destination floor from the detected number of in-cage passengers, means for setting the limit of in-cage passenger number, and means for detecting serviceable floors by comparing the forecast number of in-cage passengers for each floor obtained by the addition and subtraction with the limit of in-cage passenger number.

16 Claims, 33 Drawing Figures

FIG. 1

| | 10F | 9F | 8F | 7F | 6F | 5F | 4F | 3F | 2F | 1F |
|---|---|---|---|---|---|---|---|---|---|---|
| (1) CAR POSITION | | | | | | | | | ↑ | |
| (2) CAGE CALL | | ○ | | | ○ | | | | | |
| (3) NUMBER OF IN-CAGE PASSENGERS | | | | | | | | | 7 | |
| (4) NUMBER OF PASSENGERS FOR DESTINATION FLOOR | | 4 | | | 3 | | | | | |
| (5) HALL CALL | | | | △ | | | △ | | | |
| (6) NUMBER OF HALL WAITING PASSENGERS | | | | 4 | | | 2 | | | |
| (7) FORECAST NUMBER OF PASSENGERS AT EACH FLOOR | | 10-4=6 | 10 | 6+4=10 | 9-3=6 | 9 | 7+2=9 | 7 | | |

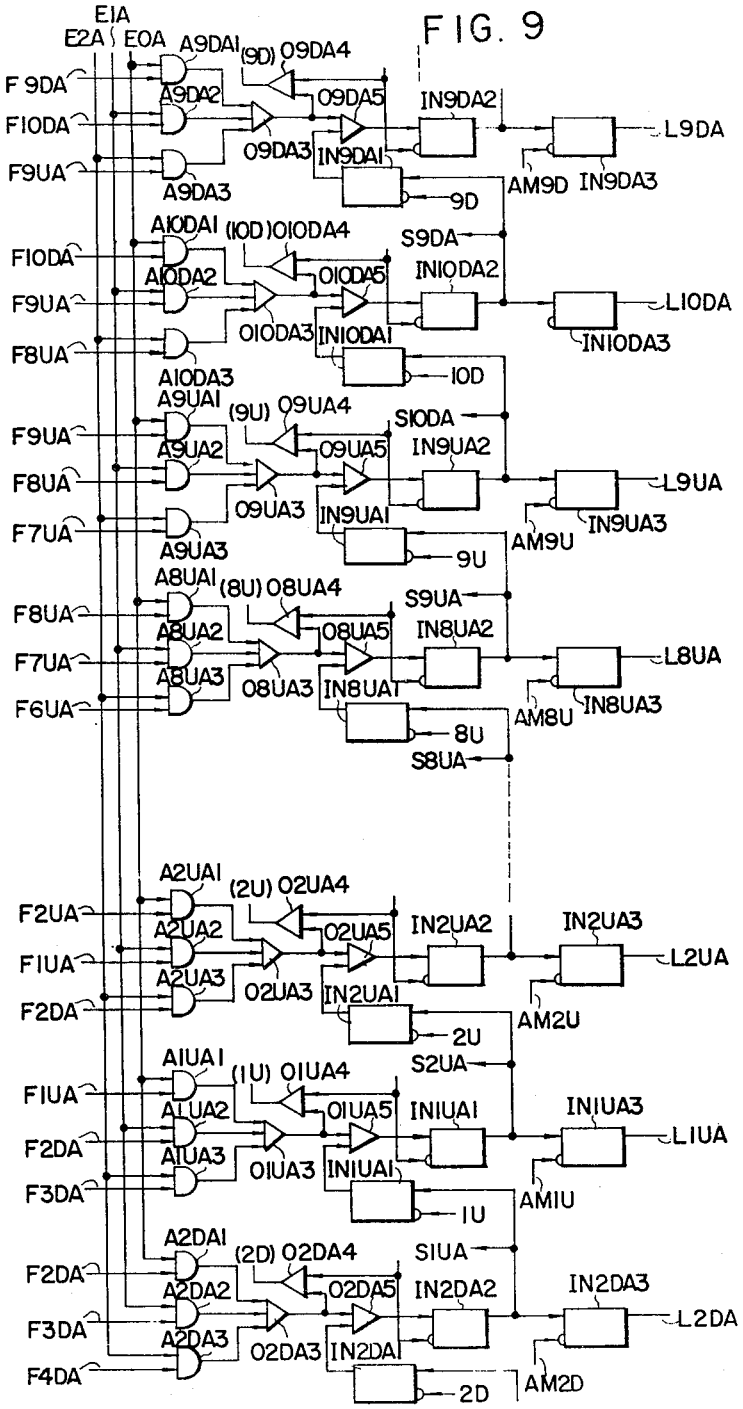
FIG. 9
E1A
E2A
E0A
F9DA
F10DA
F9UA
A9DA1
(9D)
09DA4
A9DA2
09DA5
IN9DA2
L9DA
09DA3
IN9DA1
A9DA3
AM9D
IN9DA3
9D
F10DA
F9UA
F8UA
A10DA1
(10D)
010DA4
S9DA
A10DA2
010DA5
IN10DA2
L10DA
010DA3
IN10DA1
IN10DA3
A10DA3
10D
F9UA
F8UA
F7UA
A9UA1
(9U)
09UA4
S10DA
A9UA2
09UA5
IN9UA2
L9UA
09UA3
IN9UA1
IN9UA3
A9UA3
AM9U
9U
F8UA
F7UA
F6UA
A8UA1
(8U)
08UA4
S9UA
A8UA2
08UA5
IN8UA2
L8UA
A8UA3
08UA3
IN8UA1
IN8UA3
AM8U
8U
S8UA
F2UA
F1UA
F2DA
A2UA1
(2U)
02UA4
A2UA2
02UA5
IN2UA2
IN2UA3
L2UA
A2UA3
02UA3
IN2UA1
AM2U
2U
F1UA
F2DA
F3DA
A1UA1
(1U)
01UA4
S2UA
A1UA2
01UA5
IN1UA1
IN1UA3
L1UA
A1UA3
01UA3
IN1UA1
AM1U
1U
F2DA
F3DA
F4DA
A2DA1
(2D)
02DA4
S1UA
A2DA2
02DA5
IN2DA2
IN2DA3
L2DA
A2DA3
02DA3
IN2DA1
AM2D
2D

ELEVATOR CONTROL SYSTEM

The present invention relates to an improvement in the elevator control system, or more in particular to an elevator control system provided with an elevator-passenger number forecasting means provided to forecast the number of in-cage passengers for each floor.

In recent group-controlled elevator systems, the generation of a hall call is followed immediately or with a certain time delay by the information being delivered to the prospective waiting passenger as to a service car. This method is closely watched as a superior system whereby hall waiting passengers, on the elevator landing to be served by a multiplicity of cars, are able to wait in front of the door of a service car without any hesitation. For such a guidance and indication system for early indication of the service car, there are two methods as mentioned below.

In one of such methods, the service zone of each car is determined in accordance with the relative positions of the cars changing at every moment, in such a manner that the up and down calls for all the floors may be covered by combining the service zones of all the cars. By so doing, it is possible to determine immediately from the prevailing service zones a car to serve a hall call, whenever it is generated.

The other method is one in which a car most suitable for serving a hall call is determined at the time point when that hall call is generated, on the basis of a number of types of information stored for each car.

The service car indicated on the landing in any of the above-mentioned methods must not be changed. If a car other than the indicated one arrives earlier than the service car, it gives rise to a disbelief on the part of prospective passengers, thus making the elevator control system useless.

As a measure to prevent such an error, a method is considered in which the guiding and indication is done only after the car to serve the waiting passengers has been determined. This method reduces the risk of the erroneous indication attributable to the outrunning of one car by another, but is not effective in the case where a travelling car is filled to capacity before arriving at the calling floor. In other words, even if it is decided that, say, car A will obviously be able to serve a hall call earlier than the other cars at the time point when it is issued, its first arriving at the calling floor will be of no use if it is filled up with in-cage passengers earlier.

Also, a car with little room for additional in-cage passengers will not be able to offer good service or its operating efficiency deteriorated even if it responds to a hall call generated at a floor where many prospective passengers are waiting.

Furthermore, a method for determining a service can has been suggested in which the number of in-cage passengers is another factor taken into consideration in serving a hall call. This method, however, has commercially failed because of the difficulty in forecasting the number of in-cage passengers changing at every moment. In spite of this, the forecasting of the number of in-cage passengers is inevitable if the cars are to be controlled in group with a high operating efficiency while at the same time offering good service to the passengers.

A general object of the present invention is to provide a highly efficient elevator control offering satisfactory service to the passengers by forecasting the number of in-cage passengers at the time point of arrival at each floor.

The principal feature of the invention is to detect the present total number of in-cage passengers and the number of in-cage passengers for every destination floor, and by the use thereof, to forecast the number of in-cage passengers at time point of arrival at each floor.

In other words, the present value of the number of in-cage passengers is detected by a well known weighing device, and the in-cage passengers' destination floors are detected by the cage calls registered by them. Thus it is possible to allot the number of in-cage passengers to the destination floors. This allotment may be uniform over all the destination floors or larger to certain floors or floor than to the others.

Disregarding the prospective passengers expected to take the car in the future, the number of in-cage passengers at time point of arrival at each floor is forecast by subtracting the number of in-cage passengers allotted to that particular floor from the number of prevailing in-cage passengers.

Another feature of the present invention is to add to the result of subtraction a fixed value for all the floors or different specified values for different floors respectively, in determining the number of waiting passengers, at a floor generating a hall call, on the assumption that prospective passengers in the number corresponding to such a fixed or specified values will take the car at the particular floor or floors.

By constructing the elevator control system in that way, it is possible to forecast approximately the number of in-cage passengers taking into account the prospective passengers taking the car in the future.

The accuracy of this forecasting may be improved up to a practicable level by setting an average number of prospective passengers taking the car which is determined on the basis of the total of the passengers taking the car at the respective floors, depending on the nature of the building involved.

A third feature of the invention is to adjust the setting of the number of additional passengers getting into the car according to the prevailing traffic demand. As disclosed in detail by U.S. Pat. No. 3,642,099, it is well known to detect the elevator traffic demand in a multiplicity of forms, and the setting of the number of passengers taking the car may be adjusted by the use of the result of such a detection. Generally, it is true that the more congested traffic is, the more persons are considered to take the cars anew. The adjustment of the setting thus permits the forecasting accuracy of the number of in-cage passengers to be further improved.

A fourth feature of the present invention is to arrange a hall waiting passenger number detector at each floor and to add the results of detection by all of such detectors.

The hall waiting passenger number detector which may be employed includes the following:

1. The device operating on mat switches

A multiplicity of mat switches are arranged on as many units of floor space each measuring, say, 60 cm by 40 cm, required to accommodate each prospective passenger on the landing of each floor, so that the number of prospective passengers waiting on the floor landing is detected by the number of such mat switches energized;

2. The device operating on ultrasonic wave:

A multiplicity of ultrasonic wave transmitters and receivers are mounted on the ceiling or side walls of each landing, so that the presence or absence of persons on or in the vicinity of the landing is detected by the travel time of reflected wave thereby to know the number of the hall waiting passengers; or 3. The device using an industrial television camera (ITV):

An ITV is arranged directed toward each landing whereby the number of hall waiting passengers is determined by detecting the presence or absence of persons on the basis of the state of the output or variations of the picture elements of the camera.

By employing the hall waiting passenger number detectors as mentioned above, the accuracy with which the number of in-cage passengers is forecast is highly improved.

A fifth feature of the present invention is to provide the above-described hall waiting passenger number detector only at specified floors and the number of passengers at each of the other floors is forecast by the setting already mentioned.

The hall waiting passenger number detector is high in cost and therefore it is not economical to provide it at every floor. For this reason, it is arranged only at a base floor or floors or those floors comparatively frequented by passengers. By reference to the detection by these hall waiting passenger number detectors arranged on the base or specific floors, the setting for the other floors may be readjusted.

This configuration makes possible an economical and highly accurate in-cage passenger number forecasting device.

The number of in-cage passengers forecast as above may be applied in various forms to the elevator control. An explanation will be made, in this specification, of a couple of examples such as utilized for selection of a service car to a hall call among a plurality of cards in juxtaposition.

The forecast number of in-cage passengers thus detected for each floor is compared with a predetermined value thereby to determine floors serviceable.

In one of such examples, the provisional service zones to be taken charge of the respective cars are determined from the relative positions thereof, so that the floors determined serviceable as above and included in the provisional service zone of a car are defined as the service zone of the car.

Further, the provisional service zone of a car is defined as the secondary provisional service zone of a succeeding car, so that the floors not included in the service zone of any car is added to the service zone of a car the secondary provisional service zone of which includes such floors.

According to the present invention, there is provided, in an elevator control system comprising a plurality of cars for serving a multiplicity of floors, hall call register means provided at each floor landing, cage call register means mounted in each cage and means for detecting the total number of in-cage passengers in each car; the improvement further comprising means for forecasting the number of the passengers for every destination floor by allotting the detected number of in-cage passengers to the cage calls, and means for forecasting the number of in-cage passengers at each floor by subtracting sequentially the number of in-cage passengers for destination floor from the detected total number of in-cage passengers.

The above and other objects, features and advantages will be made apparent by the detailed description taken in conjunction with the accompanying drawings, in which:

FIG. 1 is a diagram for explaining the fundamental principle of the present invention;

FIG. 9 shows a circuit for setting provisional service zones;

To facilitate the understanding of the invention, it will be explained briefly with reference to a simple diagram of FIG. 1.

It is assumed that there are three cars A to C provided in juxtaposition for serving a building having ten floors from the 1st to 10th floors and that car A is in the state as shown in FIG. 1. In other words, 1. Car A is located at the second floor for up travel (actually, a position slightly lower than the second floor level where it is still able to serve an up call from the second floor);

2. Cage calls for the 6th and 9th floors are registered in car A;

3. There are seven passengers in car A;

4. The number of in-cage passengers for the 6th floor is three and that for the 9th floor is four;

5. Up hall calls are generated at the 4th and 7th floors; and

6. The number of hall waiting passengers associated with the hall calls are two and four respectively.

In forecasting the number of in-cage passengers at the time point of arrival at each floor in car A in this state, the number of new passengers getting into the car may be added to and the number of passengers getting off subtracted from the present number of in-cage passengers. As a result, the number of in-cage passengers at each floor may be forecast as shown in the column to the extreme right of FIG. 1.

Assuming that the allowable number limit of passengers in each car is up to ten, it will be seen that an up hall call, if generated at the 8th floor, should not be served. Such subsequent hall calls for up travel that may be generated at the 8th floor are served by another car or preferably by a succeeding car. In other words, it has been decided that car A is able to serve up hall calls generated at from the 2nd to 7th and 9th floors. An example of this system, as applied to the car allotment based on service zones, will be described with reference to FIG. 2.

Figure 2:
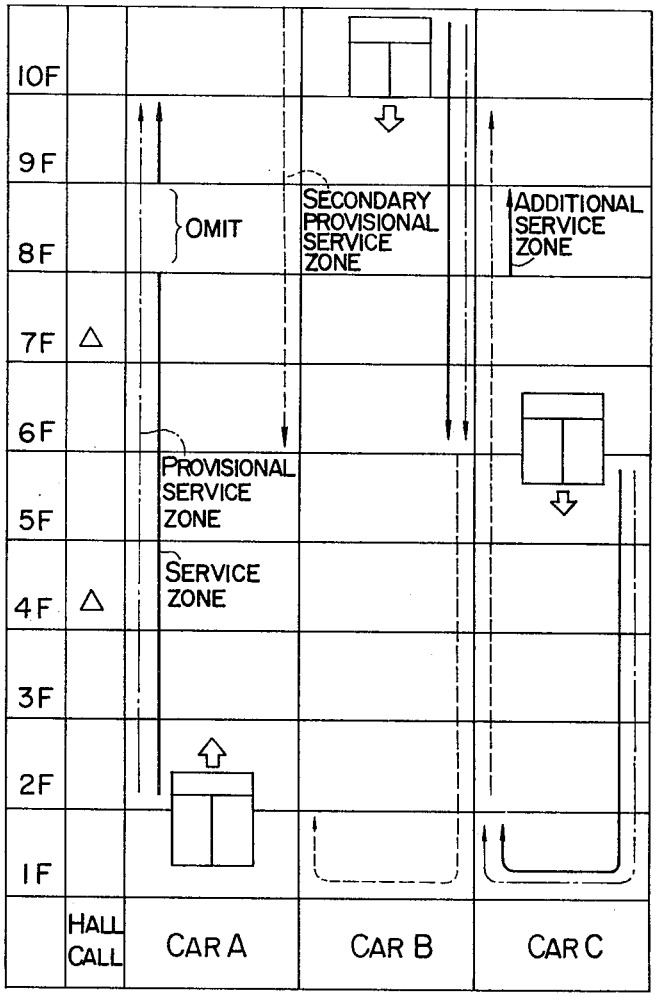
FIG. 2 is a diagram for explaining the elevator group control utilizing the present invention according to a first embodiment.

The diagram of FIG. 2 illustrates the service zones of cars A, B and C, assuming that car A is situated at the second floor for up travel, car B at the 10th floor for down travel and car C at the 5th floor for down travel (actually, at a position higher than the 5th floor as already mentioned with reference to car A). In this case, the provisional service zone of each car is most properly determined as the area extending from the position thereof to that of an immediately leading car, as shown by one-dot lines in the drawing under consideration. Each car is so controlled as to serve hall calls generated in the provisional service zone thus defined. Needless to say, these service zones undergo constant changes according to the movement of the cars.

It has already been mentioned that the decision has been made that car A is not in a condition to serve an up hall call from the 8th floor. Thus the up hall call from the 8th floor should be removed from the provisional service zone of car A, with the result that the true service zone of car A covers up hall calls from the 2nd to 7th floors and 9th floor. Therefore, in the shown state, car A is able to serve up hall calls from the 2nd, 3rd, 5th, 6th and/or 9th floors which may be subsequently generated, in addition to up hall calls from the 4th and 7th floors. Each time car A is determined to take charge of a hall call generated at any of the above-mentioned floors, the number of hall waiting passengers associated with the hall call thus taken charge of is taken into consideration in deciding, in the manner mentioned earlier, the serviceability to a subsequently generated hall call, which, if determined serviceable, will be served. Incidentally, the true service zones of the respective cars are shown by solid arrows.

In this way, the system according to the invention is provided with a service zone setting device which defines true service zone of a car covering those floors which are both determined serviceable by the serviceable floor decision device and included in the provisional service zone of the particular car.

By constructing the present invention in this way, it is possible to render a car serve properly only hall calls other than those which, if served, result in an overloaded situation of the car or in the number of in-cage passengers being improper in view of the prevailing traffic demand.

Next, those hall calls which are removed from the true service zone of car A such as the up hall call from the 8th floor are required to be taken care of by another car. For this purpose, what might be called a secondary provisional service zone is set for each car in the first embodiment. In FIG. 2 is shown the operating sequence of the cars which is car A to car C to car B to car A. Car C is immediately following car A, car B following car C, and car A following car B. The provisional service zones of the respective cars are determined to be the secondary provisional service zones of the cars immediately following them respectively, as illustrated in dashed-line arrows in FIG. 2. A hall call which does not belong to the true service zone of any car such as the up hall call from the 8th floor is allotted to one of the cars according to the secondary provisional service zones. In the cited case, an up hall call generated from the 8th floor belongs to the secondary provisional service zone of car C and therefore will be served by car C.

Figure 3:
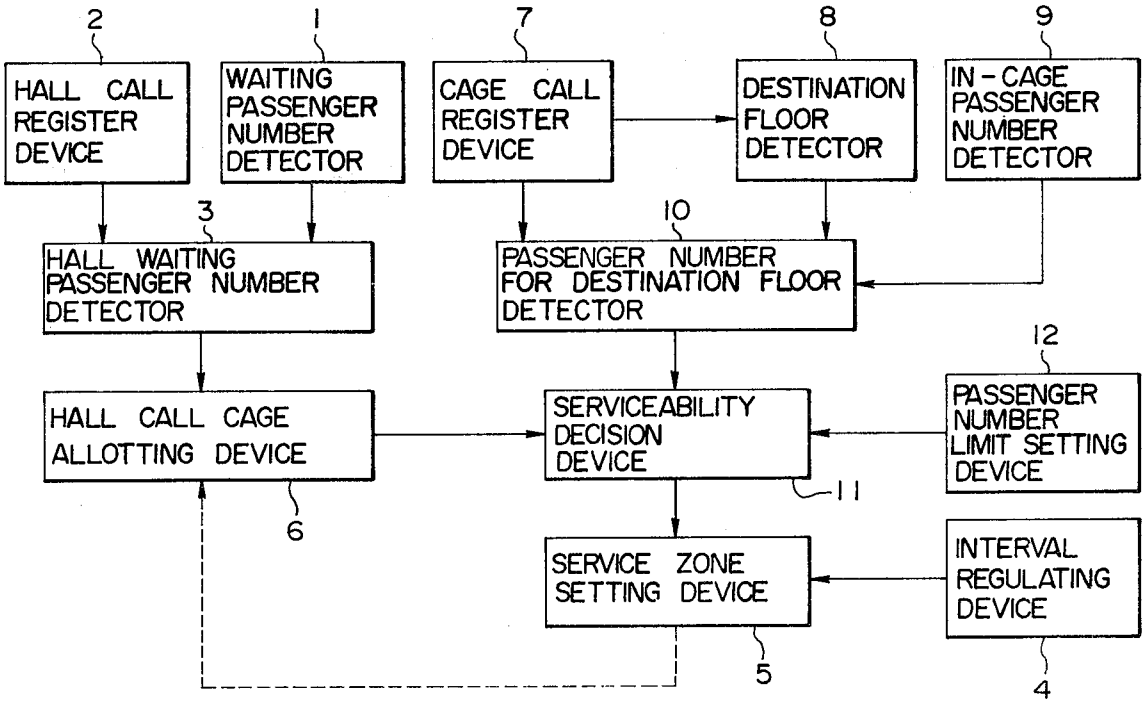
FIG. 3 is a block diagram schematically showing the configuration of the apparatus of FIG. 2.

The foregoing is an outline of the first embodiment of the hall call allotment utilizing the present invention, the whole configuration of which will be described below with reference to FIG. 3.

The waiting passenger number detectors 1 are arranged at the landing of the respective floors. Of these waiting passenger number detectors 1, those at the floors generating hall calls are picked up by a hall call detector 2, and the number of waiting passengers at each of the floors generating the calls is produced from the hall waiting passenger number detector 3.

An interval regulating device 4 is provided for uniformly distributing a multiplicity of juxtaposed cars among a multiplicity of floors to be served. In response to the signal from the interval regulating device 4, a service zone setting device 5 sets the provisional service zone of each car. A hall call cage allotting device 6 temporarily allots a hall call to what is considered to be the most suitable car in accordance with the pattern of provisional service zones.

Also, calls generated in each car are detected by the cage call detector 7 and the destination floors associated therewith are detected by destination floor detector 8, of which one is easily informed by the control panel inside the cage. A well known weighing device or the like including an in-cage passenger number detector 9 is used to detect the number of in-cage passengers. The output of the in-cage passenger number detector 9 is classified according to the destinations by the passenger-number-for-destination-floor detector 10 thereby to detect the number of passengers for every destination floor.

A serviceability decision device 11 is for forecasting the number of in-cage passengers at each floor on the basis of the number of in-cage passengers for every destination floor, the number of waiting passengers at each of the floors generating the hall calls to be taken care of and the present actual number of in-cage passengers, and for deciding whether or not the forecast result exceeds the load limit predetermined by the setting device 12. In this way, it is decided whether or not a car is able to serve a hall call, and if determined serviceable, such a hall call is formally allotted to that particular car. As for a subsequently generated hall call, the car makes decision whether to serve it or not, considering the fact that the preceding hall call has already been taken charge of. Thus, a true service zone is determined on the basis of the provisional service zone by sometimes omitting part thereof.

An actual example of the above-mentioned first embodiment will be explained below with reference to FIGS. 4 to 16.

Figure 4:
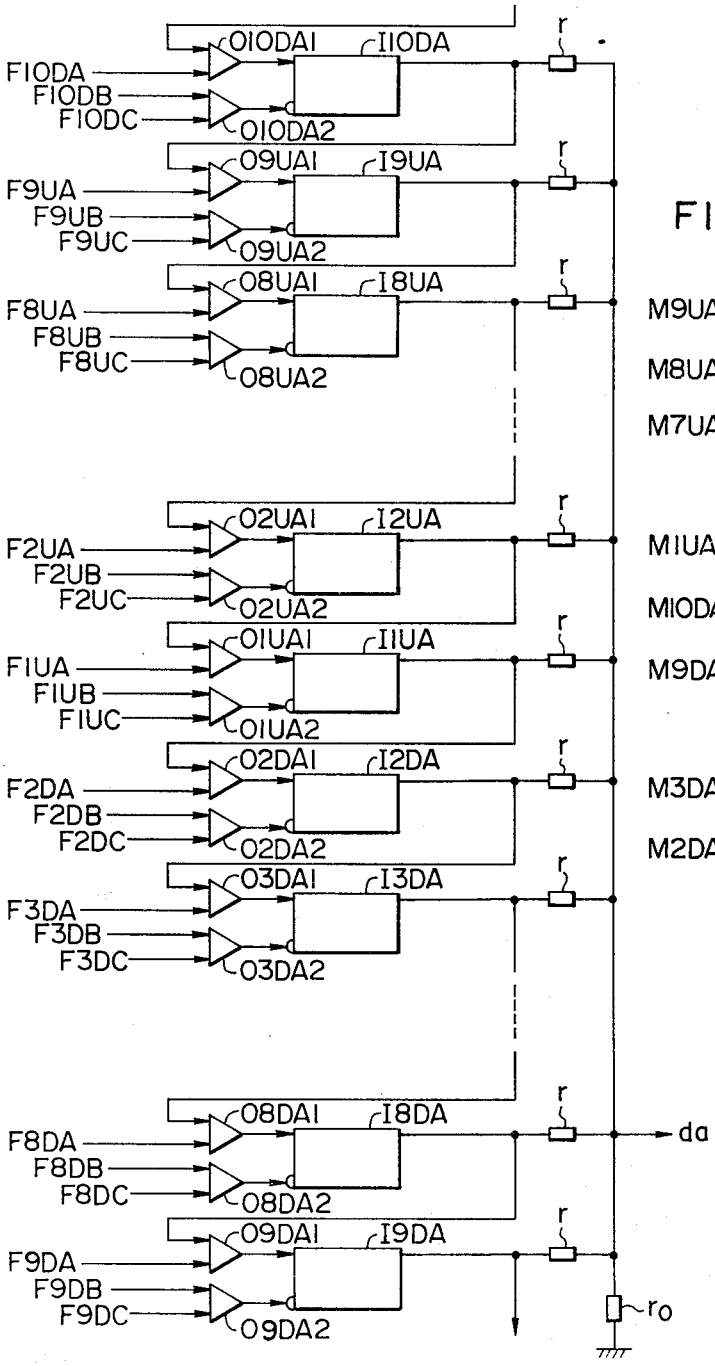
FIG. 4 shows a circuit for detecting the spatial interval of a car from a succeeding car.

First, reference is made to FIGS. 4 to 11 showing the part corresponding to the interval regulating device, which represents a modification of the U.S. Pat. No. 3,729,066. The diagram of FIG. 4 shows a circuit for detecting the spatial interval of a car with a succeeding car, which is provided for each car. The description here will be centered on car A among the three cars A, B and C. In the drawing, reference symbols are respectively defined as follows:

F1UA to F9UA: Position signals of car A travelling up at the 1st to the 9th floors respectively;

F2DA to F10DA: Position signals of car A travelling down at the 2nd to the 10th floors respectively;

F1UB to F9UB: Position signals of car B travelling up at respective floors;

F2DB to F10DB: Position signals of car B travelling down at respective floors;

F1UC to F9UC: Position signals of car C travelling up at respective floors;

F2DC to F10DC: Position signals of car C travelling down at respective floors;

O1UA1 to O9UA2, O2DA to O10DA2: OR elements;

I1UA to I9UA, I2DA to I10DA: Inhibit elements;

$r$, $r_0$: resistors;

da: Signal representing the spatial interval between car A and a succeeding car;

As illustrated in the drawing, the elevator service floors are connected endlessly through F1U, F2D, F3D, . . . F9D, F10D, F9U, F8U, . . . F2U and F1U, so that the position signal for car A is transmitted in sequence through this chain until it is cut off by the position signal for car B or car C. At this time, the signal *da* corresponding to the spatial intervals between the cars is obtained by applying the signals from the respective floors through the resistors $r$ and $r_0$.

Let us consider a case, for example, in which car A is moving up at the 8th floor, car B moving down at the 2nd floor and car C moving down at the 5th floor. (In this case, the car immediately following car A is car B). The position signal F8UA for car A is transmitted through O8UA1, I8UA, O7UA1, . . . I3UA, O2UA1 and I2UA. However, in view of the fact that the position signal F2UB for car B is in the state of "1" thereby to prohibit the operation of I2UA in the circuit comprising O2UA2 and I2UA, the output signal of I2UA is "0", thereby preventing the signal from being transmitted any farther.

As will be noted from the above description, the output signals of I8UA, I7UA, . . . I4UA and I3UA are in the state of "1" and therefore the position signal representing the 6-floor interval is produced across the resistor $r_0$ through the resistor $r$ in the form of signal *da*. Under this condition, if the relation between resistors $r$ and $r_0$ is such that $r >> r_0$, a signal proportional to the number of floors is produced across the resistor $r_0$. In other words, the signal *da* which is proportional to the spatial interval from car A to the immediately succeeding car is obtained.

Figure 5:
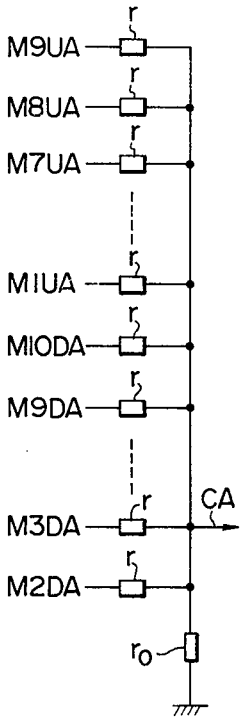
FIG. 5 shows a circuit for producing a signal proportional to the number of calls to be served.

A circuit for detecting the number of calls to be served by car A is shown in FIG. 5, in which reference symbols M1UA to M9UA and M2DA to M10DA show signals requiring the stoppage of car A, which are obtained from the hall calls and the cage calls under consideration of the elevator car travel direction. Like the circuit of FIG. 4, the voltage signal CA proportional to the number of calls is obtained through the resistors $r$ and $r_0$.

Figure 6:
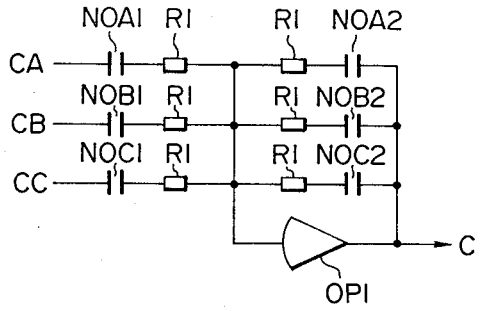
FIG. 6 shows a circuit for determining the average number of calls generated in a car.

The circuit of FIG. 6 is for adding the number of calls to be served by each car and calculating the average number of calls to be served by each car. Symbols CA to CC show the numbers of calls to be served by cars A to C respectively which are obtained as in FIG. 5, and symbols NOA1, NOA2, NOB1, NOB2, NOC1 and NOC2 show contacts which are opened when cars A to C are released from the controlled operation respectively. Symbol $R_1$ shows operational resistors, and symbol OP1 an operational amplifier for reversing the polarity of the input and output thereof.

In the case where cars A to C are in a controlled operation, the contacts NOA1, NOA2, NOB1, NOB2, NOC1 and NOC2 are all closed. Under this condition, the output C of the operational amplifier is expressed as $$C = \frac{-\frac{R_1}{3}}{R_1}(CA + CB + CC) = -\frac{1}{3}(CA + CB + CC) \qquad (1)$$

where CA, CB and CC are call inputs to cars A to C respectively.

In the event that a given car, say, car A is released from the controlled operation, $$C = \frac{-\frac{R_1}{2}}{R_1}(CA + CC) = -\frac{1}{2}(CB + CC)$$

In other words, the output C of the operational amplifier calculates the average value of the number of calls to be served by the respective cars.

Figure 7:
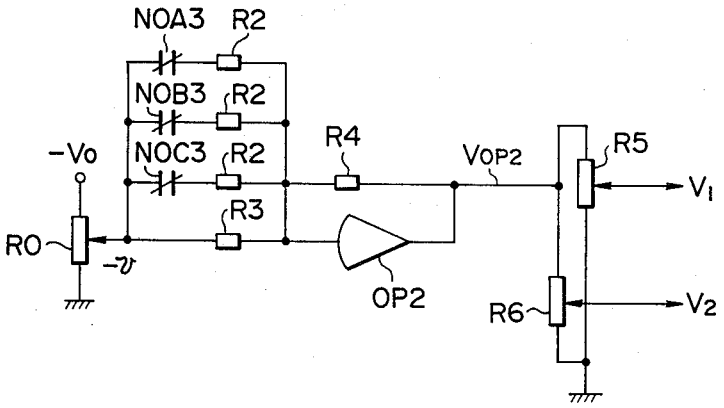
FIGS. 7 and 8 show circuits for determining the time interval of a car from a succeeding car and producing an interval limiting signal.
Figure 8:
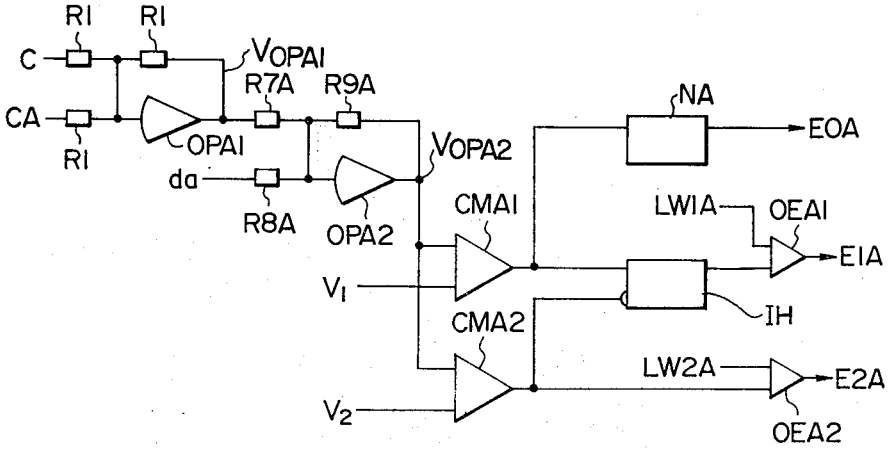

The diagram of FIG. 7 shows a circuit for producing reference voltages for the comparators in FIG. 8. Assuming that cars A to C are in controlled operation, the contacts NOA3 to NOC3 are open and therefore the output C of the operational amplifier OP2 is expressed by the following equation:

$$V_{op2} = \frac{-R_4}{R_3}(-V) = \frac{R_4}{R_3}V$$

Assume that the values of resistors $R_3$, $R_4$ and $R_0$ are selected appropriately thereby to make the $V_{op2}$ of, say, 6 volts. If car A is released from the controlled operation, the contact NOA3 is closed and the output of the operational amplifier OP2 is given as $$V_{op2} = -\frac{R_4}{R_3}(-V) - \frac{R_4}{R_2}(-V) = R_4V\left(\frac{1}{R_3} + \frac{1}{R_2}\right) \qquad (2)$$

If the value of $R_2$ is selected appropriately, it is possible to obtain $V_{op2}$ of, say, 10 volts. In this manner, by dividing appropriately the output voltage of the operational amplifier through the variable resistors $R_5$ and $R_6$, the reference voltages $V_1$ and $V_2$ are obtained for the comparators. When $V_{op2}$ is 6 volts as above, for example, the outputs of $V_1$ and $V_2$ are 5V and 4V respectively, while they are 8.3V and 6.6V when $V_{op2}$ is 10 volts.

The diagram of FIG. 8 shows a circuit for determining the time interval for car A, which is impressed with inputs thereof from the circuits of FIG. 4 to FIG. 7. In the drawing under consideration, the following reference symbols denote the following-defined meanings:

OPA1 and OPA2: operational amplifiers;

CMA1 and CMA2: comparators each of which produces a "1" signal when the sum of the two inputs thereto is zero or positive;

NA: NOT element;

IH: inhibit element;

E0A to E2A: time interval determining signals for advancing car A from its actual position to a provisional position. For instance, E0A advances car A zero floor, E1A one floor and E2A two floors.

The average number of calls obtained from FIG. 6 is subtracted from the number of calls CA to be served by car A which is derived from the circuit of FIG. 5, in the operational amplifier OPA1, with the result that the amplifier OPA1 produces an output $$VopA1 = -(CA + C) = -CA + \tfrac{1}{3}(CA + CB + CC) \qquad 3.$$

In like manner, the operational amplifier OPA2 produces an output $$VopA2 = -\frac{R_{0A}}{R_{7A}} VopA2 - \frac{R_{9A}}{R_{8A}} da \qquad (4)$$

By selecting appropriately the ratios between the resistors $R_{7A}$ and $R_{9A}$, it is possible to set a voltage corresponding to the car interval of one floor at 1V and a voltage corresponding to one call at 3 volts or thereabouts. In other words, by appropriately selecting the weight of the car intervals and that of calls, the time interval between the cars can be determined. From the above formula, $$VopA2 = -K_1\left(-CA + \frac{CA + CB + CC}{3}\right) - K_2 \cdot da$$

$$= K_1CA - \frac{K_1}{3}(CA + CB + CC) - K_2 \cdot da \qquad (5)$$

As will be easily noted from this equation, when the number of calls to be served by car A is equal to the average number of calls, the first and second terms in equation (5) are equal to each other and therefore $VopA2 = -K_2 \cdot da$. However, if the number of calls to be served by car A is larger than the average number of calls by, say, one, then $K_1CA - K_1/3\,(CA + CB + CC) = +3V$. On the other hand, if the number of calls to be served is smaller than the average number of calls by one, $$K_1CA - \frac{K_1}{3}(CA + CB + CC) = -3V$$

As will be understood from above, a time interval for a car taking into consideration the number of calls is obtained.

It is assumed that the spatial interval for car A from the immediately succeeding car is 6 floors and the number of calls to be served by car A is more than the average number of calls by one. $VopA2 = +3V - 6V = -3V$. Reference signals $V_1$ and $V_2$ of 5V and 4V respectively are assumed to be applied to the comparators CMA1 and CMA2 respectively. Then the comparator CMA1 produces an output signal in the state of "1" in response to the inputs of −3V and 5V, while the comparator CMA2 similarly produces an output signal "1" in response to the inputs of −3V and 4V. As a result, the output signal of E2A becomes "1", so that the signal E1A is in the state of "0" since the inhibit element IH is prohibited, whereas the signal E0A is also in the state of "0" since a "1" signal is applied to the NOT element NA.

In the case where VopA2 is −5V, on the other hand, the comparator CMA1 produces a "1" signal in response to the inputs thereto of −5V and 5V, whereas the output of the comparator CMA2 is in the state of "0" since its inputs are −5V and 4V. In this way, the comparators CMA1 and CMA2 determine the time interval for the car A and produce signals E0A and E2A.

Figure 10:
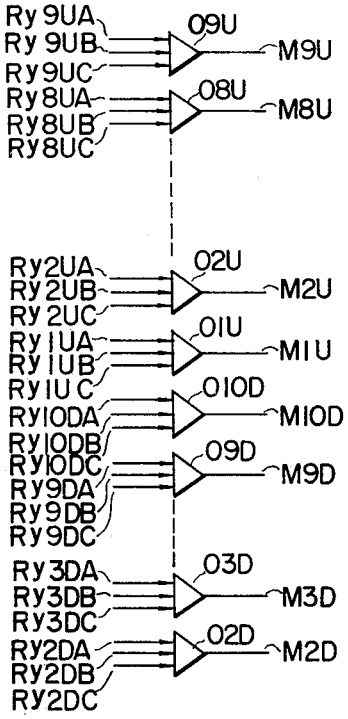
FIG. 10 shows a circuit for producing interlock signals.
Figure 11:
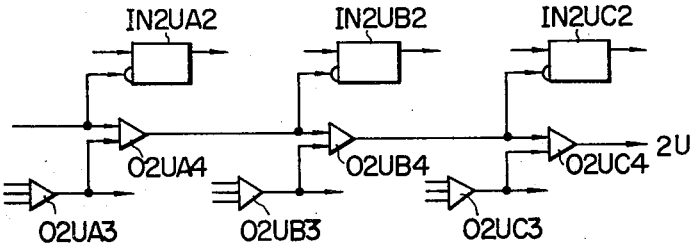
FIG. 11 shows a priority-order setting circuit.
Figure 12:
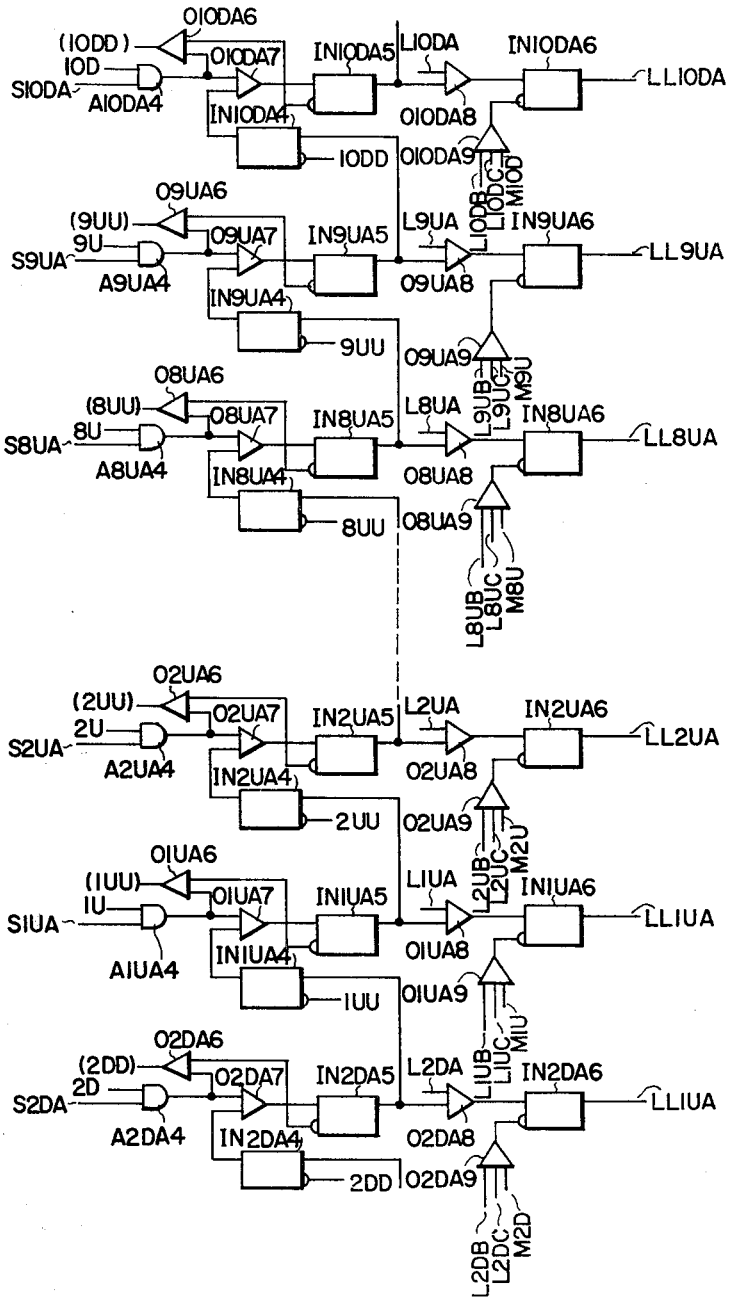
FIG. 12 shows a circuit for setting corrected service zones.

The circuits of FIG. 9 to FIG. 11 are for determining the provisional service zone of car A by the position signal for car A and the time interval signal for the same. In the drawings, the following reference symbols denote the component elements or signals as defined respectively:

A1UA1 to A9UA4 and A2DA1 to A1ODA4: AND elements; O1UA3 to O9UA5 and O2DA3 to O1ODA5: OR elements; IN1UA to IN9UA3 and IN2DA1 to IN1ODA3; inhibit elements; 1U to 9U and 2D to 10D; signals formed by OR elements as shown in FIG. 11, respectively;

M1U to M9U and M2D to M10D; signals formed as shown in FIG. 10;

HC1U to HC9U and HC2D to HC10D: up hall call signals at the 1st to 9th floors and down hall call signals at the 2nd to the 10th floors respectively;

S1UA to S9UA and S2DA to S10DA: signals connected to the circuit of FIG. 12;

L1UA to L9UA and L2DA to L10DA: service zone signals connected to the circuit of FIG. 12;

AM1U to AM9U and AM2D to AM10D: inserviceability signal derived from the circuit of FIG. 6.

In the above-described construction, let us consider a case in which time interval determining signal E0A is generated for both car A travelling up at the 2nd floor and for car B which is travelling down at the 10th floor in advance of car A. (It is assumed that car C is travelling down at the 5th floor.) The operation for determining the provisional service zones under this condition will be explained below.

The fact that car A is at the 2nd floor and the E0A signal in the state of "1" casues the AND element A2UA1 to produce a "1" signal which is applied through the OR elements O2UA3, O2UA5 and inhibit element IN2UA2. The signal from IN2UA2, on the other hand, is applied to the inhibit element IN3UA1 for the 3rd floor (not shown) and further from the 3rd to the 7th floors in sequence. The signal for the 7th floor is applied to the inhibit element IN8UA1 and transmitted therefrom through O8UA2, O9UA5, IN9UA2 and IN10DA1. In response to these signals, the output signals of the inhibit elements IN3UA3 to IN9UA3 become "1" respectively. On the other hand, the signal from O2UA3 is applied to the OR element O2UA4 and takes the form of a signal 2U through the circuit like the one in FIG. 11. In other words, one of the inputs to the OR elements O2UA4 for car A is O2UA3 and the other input is left open. The output of O2UA4 is connected to O2UB4 and IN2UB2 for car B, and the output of O2UB4 is applied to the OR element O2UC4 and IN2UC2 for car C. The output of O2UC4 takes the form of signal 2U and is applied as an inhibiting input to the inhibit elements IN2UA1, IN2UB1 and IN2UC1.

Therefore, the signals O2UA3 to O2UC3 for the respective cars are such that the inhibit elements IN-2UA2, IN2UB2 and IN2UC2 are inhibited in the priority order of cars A, B and C.

As will be noted from the forgoing description, the signal "1" from the OR element O2UA3 for car A becomes signal 2U whereby the provisional-service-zone-setting circuits for cars A, B and C are all prohibited. In the case in question, the input signal to the inhibit element IN2UC1 for car C is prohibited thereby to produce an output in the state of "0".

In like manner, the fact that car B is travelling down at the 10th floor permits the signal 10D to take the form of "1" with the result that the inhibit element IN10DA1 for car A is prohibited in operation thereby to produce an output signal in the state of "0", whereupon the output signals from IN3UA3 to IN9UA3 for car A take the state of "1". Consequently, the provisional service zone for car A is determined to be from 2U to 9U, that for car B to be from 10D to 6D and that for car C to be from 5D to 2D and 1U, so that car A produces signals L2UA to L9UA, car B signals L10DB to L6DB and car C signals L5DC to L2DC and L1UC.

The circuit shown in FIG. 9, as its detailed operation will be described later, is thus capable of producing the true service zone signals L1UA to L9UA and L2DA and L10DA by excluding from the provisional service zones those calls unable to be served. Thus the inserviceability signals are made up of AM1U to AM9U and AM2D AM10D.

The diagram of FIG. 10 shows a circuit common to all the cars for generating interlock signals M1U to M9U and M2D to M10D for interlocking the operation of the cars so as to prevent them from serving a call at the same time. This circuit produces an output is response to an output generated by the energization of one of the service decision relays shown in FIG. 13 and used for prohibiting the other cars from serving the hall call at the same floor and same direction. (The operation of such a prohibition is performed by the circuit of FIG. 12.)

FIG. 12 shows a circuit for allotting to a succeeding car the hall call which has not been allotted to any car by being eleminated from the above-mentioned true service zone, in which car A is taken as an example. (Detailed description will be made latter.)

Figure 13:
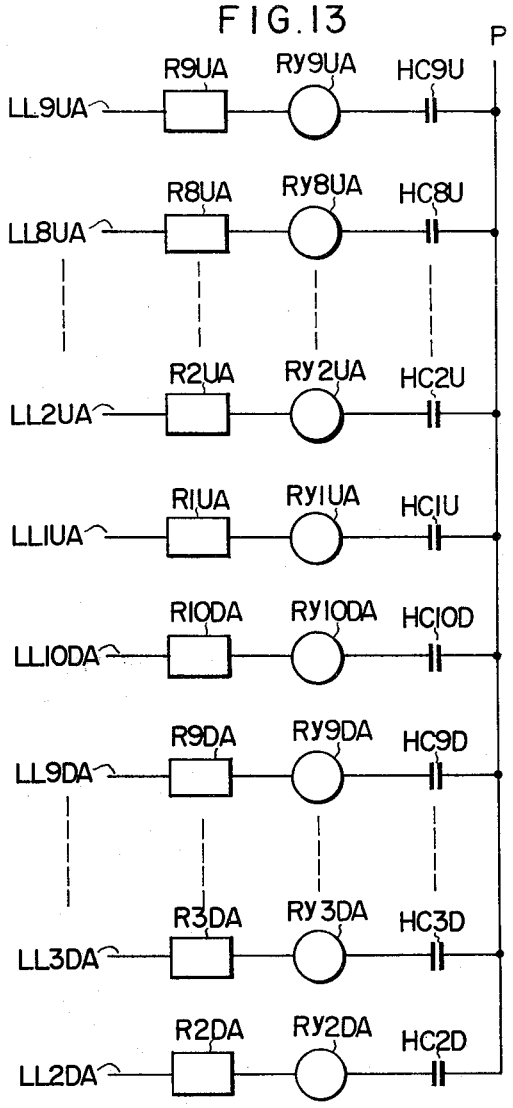
FIG. 13 shows a hall call allotting relay circuit.

The circuit of FIG. 13 is for allotting hall calls for car A to the other cars on the basis of the true service zones as determined above and the service zone signals LL1UA to LL9UA and LL2DA to LL10DA additionally supplied by the circuit of FIG. 12, as will be described more in detail later. In this Figure, HC1U to HC9U as well as HC2D to HC10D designate contacts of relays which remain in the on state when up hall calls at the 1st to the 9th floors and down In calls at the 2nd to 10th floors are registered, respectively. (The detail described later)

Figure 14:
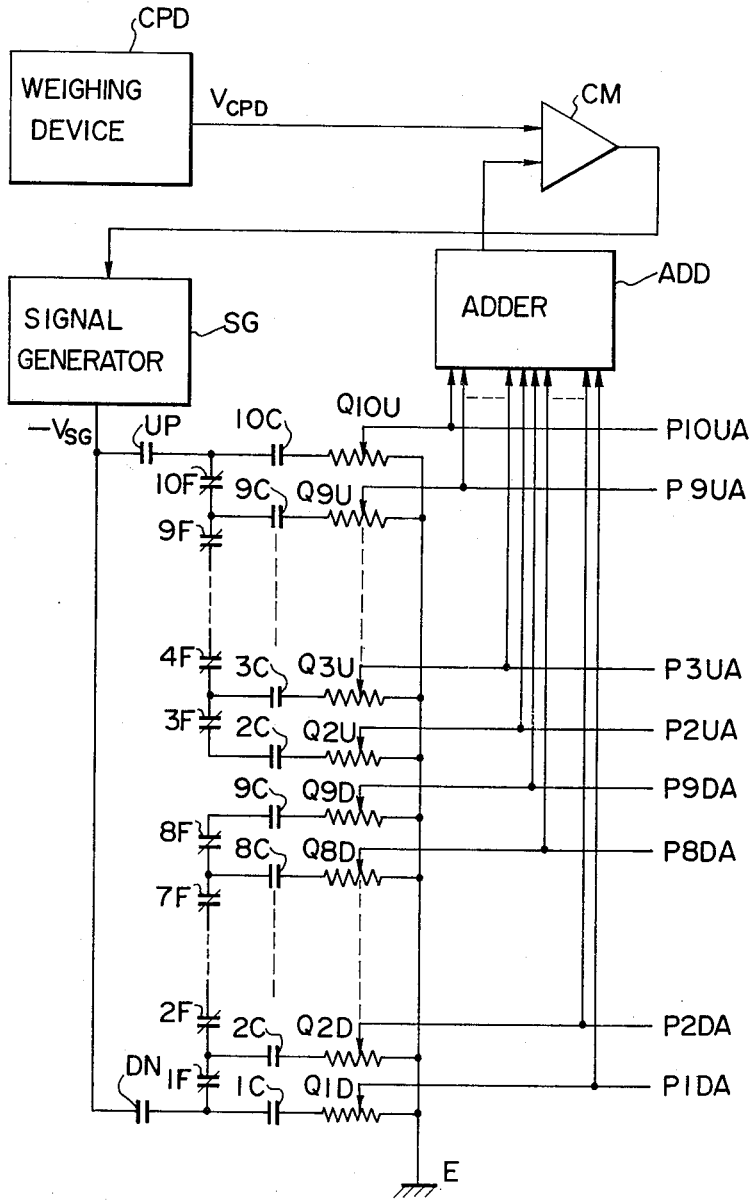
FIG. 14 shows an in-cage passenger-number-for-destination-floor detector circuit embodying the invention.

The diagrams of FIG. 14 to FIGS. 16A to 16D show an embodiment wherein the number of in-cage passengers at each floor is forecast and the serviceability is decided on the basis of such forecasting. Referring first to FIG. 14 showing a circuit for distributing the number of in-cage passengers in car A to respective destination floors, the in-cage passenger number detector CPD includes a weighing device buried in the undercarriage of each car, the output $V_{CPD}$ of which represents a signal proportional to the actual number of in-cage passengers. In the case where cage calls are generated for the 9th and 10th floors in the car travelling up at the 4th floor, for example, the voltage $V_{SG}$ is applied to the variable resistors $Q_{10U}$ and $Q_{9U}$ from the signal generator SG to UP to ADD, and also from SG to UP to 10F to 9C to $Q_{9U}$ to E. The variable resistors $Q_{10U}$ and $Q_{9U}$ are set at predetermined ratios (the setting being, for example, at $Q_{10U}$ and $Q_{9U}$), and therefore their outputs, namely, the number of passengers destined for the 10th and 9th floors are respectively $-V_{SG} \cdot Q_{10U}$ and $-V_{SG} \cdot Q_{9U}$. These signals are added in the adder ADD and the result of addition is compared with the output of the in-cage passenger number detector CPD in the comparator CM. When the sum of inputs to the comparator CM, namely, $V_{CPD} + (-V_{SG} \cdot Q_{10U} - V_{sg} \cdot Q_{9U})$ is positive, the absolute value of the output voltage of the signal generator SG is further increased, so that the comparator regulates the signal generator SG in such a manner that $V_{CPD} - (V_{SG} \cdot Q_{10U} = V_{SG} \cdot Q_{9U}) = 0$.

Therefore, if the signal level of the number of in-cage passengers is rendered the same as that of the signal voltage generator SG, the signals derived from $Q_{10U}$ and $Q_{9U}$ are respectively ones corresponding to the number of in-cage passengers destined for the 10th floor and that for the 9th floor.

As a result, in the case where the traffic demand is uniform over the 1st to 10th floors, it is generally possible to distribute the number of in-cage passsengers to respective the destination floors without any great error by setting the variable resistors $Q_{1U}$ to $Q_{9U}$ and $Q_{2D}$ to $Q_{10D}$ at the same ratio. Assuming, for example, that the presence of 9 persons in the car is detected by the in-cage passenger number detector or weighing device and the registration buttons for the 5th, 6th and 7th floors on the control panel in the car are depressed, then it is decided that three persons are destined for the 5th, 6th and 7th floors respectively.

Such a circuit schematically shown may be improved in accuracy by employing the means for determining the number of passengers for the destination floor which utilizes the history of passengers getting on and off after every trip of the car. Also, the setting of the variable resistors may be readjusted in accordance with the traffic demand and the nature of each floor in the building.

The in-cage passenger-number-for-destination-floor signals P2UA to P10UA and P10DA to P9DA thus obtained are transmitted to the circuit of FIGS. 16A to 16D.

Figure 15:
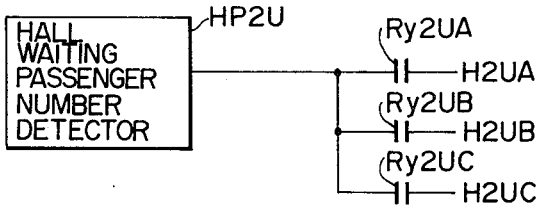
FIG. 15 shows a circuit for distributing the output of the hall waiting passenger number detector.

The diagram of FIG. 15 shows a distribution circuit for applying a signal from the waiting passenger number detector on the landing of a given floor, say, the hall waiting passenger number detector HP2U of the 2nd floor to the circuit of FIGS. 16A to 16D. As already explained, the waiting passenger number detector is comprised of mat switches or the like, and the output signal therefrom is applied in the form of signals H2UA to H2UC to the passenger number forecasting circuits for the respective floors in the serviceability decision circuit of FIG. 16A through the appropriate one of the contacts of the service relays Ry2UA to Ry2UC (handling the up travel at the second floor) specified by the circuit of FIG. 13.

Instead of detecting the number of passengers directly, the waiting passenger number detector HP2U may operate on the basis of the forecasting experience and thus may comprise a setting device with a plurality of settings and switching means for switching the output of the setting device according to the prevailing traffic demand.

The serviceability decision circuit of FIGS. 16A to 16D includes a circuit for forecasting the number of in-cage passengers at the time of arrival of car A at leading floor and a circuit for deciding whether or not the forecast number of in-cage passengers exceeds a predetermined value. The drawing under consideration concerns only car A for up travel, and the description below will be made with specific reference to FIG. 16A.

First, the present total number of in-cage passengers $V_{CPD}$ is applied to the adder AD1UA through the contact UP energized during the up travel of car A. This adder AD1UA is also impressed with the signal H1UA representing the number of waiting passengers at the 1st floor, so that the sum of the two inputs is applied to the adder AD2UA. In this case, the signal H1UA representing the number of prospective passengers waiting at the 1st floor is not generated unless it is decided that car A serve an up hall call from the 1st floor, as will be seen from the description with reference to FIG. 15. As a result, in the absence of a basement, it will be safe to conclude that the signal H1UA is produced only when car A is staying at the 1st floor, an up hall call from the 1st floor is issued and car A has responded to that particular hall call. For this reason, the output $V_{CPD}$ of the in-cage passenger number detector will probably be zero. In other words, the output of the adder AD1UA indicates the number of passengers in car A at the time of starting from the 1st floor with generation of the signal H1UA representing the number of hall waiting passengers at the 1st floor who are going to get on car A. Of course, if there is no up hall call generated at the 1st floor, or if an up hall call is generated at the 1st floor but not served by car A, then the signal H1UA is not produced, so that the output of the adder AD1UA, that is, the signal representing the number of in-cage passengers at the time of starting of car A from the 1st floor is in the state of "0".

The adder AD2UA in the subsequent stage is for calculating the number of in-cage passengers of car A at the time of starting thereof from the 2nd floor. For the purpose of such a calculation, it is necessary to subtract from the number of in-cage passengers before the arrival of car A at the 2nd floor, that is, from the output of adder AD1UA, the number of passengers getting off at the 2nd floor, and at the same time to add to the output of the adder AD1UA the number of passengers getting on at the 2nd floor.

The number of passengers getting off at the 2nd floor can be calculated, as explained with reference to FIG. 14 and the preceding embodiment, on the basis of the number of passengers for every destination floor. The signal P2UA indicating the number of passengers destined for the 2nd floor is applied in negative form to the adder AD2UA and subtracted from the present number of passengers. Also, the number of passengers expected to get on the car at the 2nd floor is detected by the hall waiting passenger number detector HP2U in FIG. 15, so that when an up hall call is generated from the 2nd floor and it is decided that car A serve that hall call, the signal H2UA representing the number of passengers expected to get on at the 2nd floor is produced through the contact Ry2UA This signal is added to the other input at the adder AD2UA, the output of which is a signal forecasting the number of in-cage passengers for car A at the time of starting thereof from the 2nd floor. In this way, the number of passengers in the car at each floor is forecast.

The adding and subtracting operation is effected in such a manner that the forecast number of passengers who get off at a destination floor designated by the control panel in the car is subtracted only at the particular floor, while on the other hand the number of waiting passengers at a floor generating a hall call, which it has been decided car A serve, is added only at that floor.

Thus, it is possible to forecast the number of in-cage passengers at the time of starting from whichever floor the car is located. When the car changes its direction of travel, it will be obvious that quite a similar circuit configuration can be realized by introducing the passenger number signal $V_{CPD}$ through the down travel signal DN.

Next, the comparators CN2UA to CM9UA connected to the adder group mentioned above are for comparing the setting vo of number of in-cage passengers with the forecast number of in-cage passengers at the time of starting from each floor, and producing output signals AM2U to AM9U respectively when the forecast value exceeds the setting vo.

Even if a car is selected which is most suitable for serving a hall call in accordance with its provisional service zone, such a selection is useless if the prospective passengers cannot get on the car due to the car being filled to capacity. Also, there may be a case in which it is not recommended under the prevailing group control condition that a certain car is loaded with more than a certain number of passengers. It is according to such a changing condition that a passenger number limit common to all the cars or limits applicable to individual cars are determined. The signals AM2U to AM9U thus obtained are used for preventing a specified car or cars from serving a specified floor or floors after deciding that it is not proper for the car or cars to serve such a floor or floors.

The explanation will be continued by turning back to FIG. 9, FIG. 12 and FIG. 13.

The description has already been made up to a point where the provisional service zones are set. The service zone signals are not transmitted any further than the inhibit elements IN1UA3 to IN9UA3 and IN2DA3 to IN10DA3 as they are obstructed thereby in the event that an appropriate prohibit signal among the prohibit signals AM is generated at the time of generation of the service zone signals. In the absence of any appropriate prohibit signal generated, by contrast, the service zone signals are applied through L1UA to L9UA and L2DA to L10DA to the OR elements O1UA8 to O9UA8 and O2DA8 to O10DA8, and thus take the form of service zone signals LL1UA to LL9UA and LL2DA to LL10DA through the interlocking inhibit elements for preventing the setting of overlapped service zones for different cars.

These signals are applied to the circuit of FIG. 13 and, through the memory elements R1UA to R9UA andR2DA to R10DA, operate in such a manner as to energize the service relays Ry1UA to Ry9UA and Ry2DA to Ry10DA upon the generation of hall calls HC1U to HC9U and HC2D to HC10D. These memory elements are so constructed as to store and maintain any energized state of the service relays, and upon completion of the intended service or arrival at the intended floor in answer to an appropriate hall call, release themselves from the stored state.

In this way, the service relays Ry1UA to Ry9UA and Ry2DA to Ry10DA are energized only in response to a hall call which does not accompany any inserviceability signals AM associated with the floors included in the provisional service zone of the car concerned. A car is thus specified to serve the hall call.

Figure 16A:
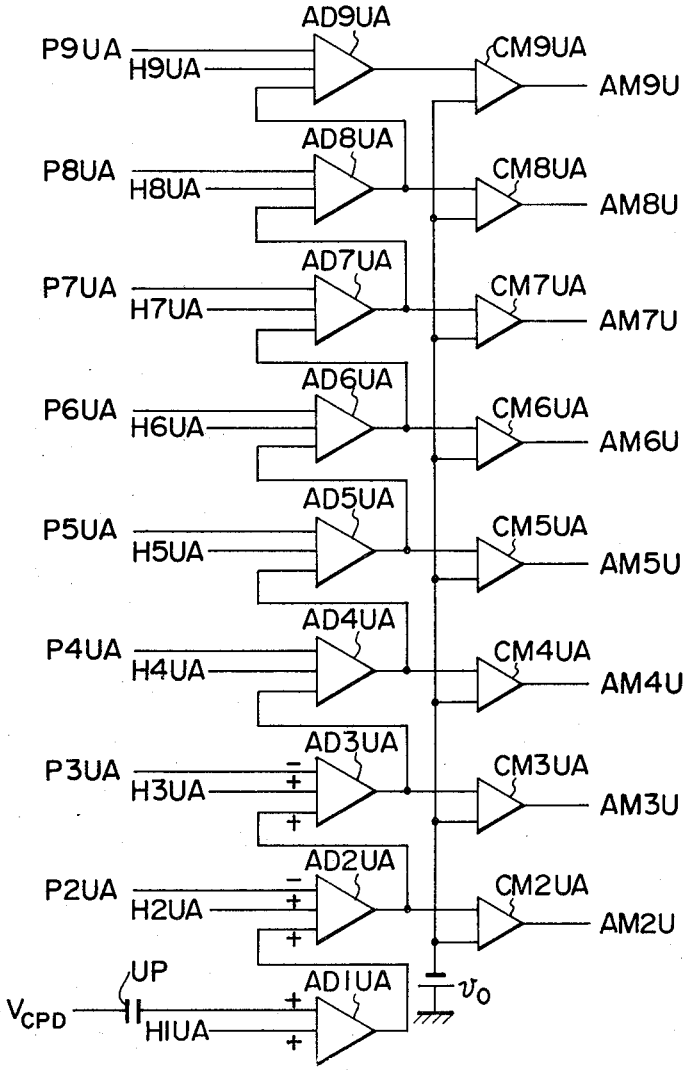
FIGS. 16A to 16D show four different embodiments of the serviceability decision circuit.

Referring to the embodiments of FIG. 1 and FIG. 2 in this condition, the calculation shown in the extreme right side (7) of FIG. 1 is effected by the adders AD1UA to AD9UA in FIG. 16A. In the case where the passenger number limit setting *vo* is a voltage corresponding to, say, 10 persons, the comparators CM7UA and CM8UA corresponding to the 7th and 8th floors produce outputs. As a result, the inserviceability signals AM7U and AM8U are produced thereby to prohibit the generation of the signals L7UA and L8UA in FIG. 9. At the next instant, the signal LL7UA that has thus far been present disappears. However, it is ineffective since as mentioned earlier the energized state of the relay Ry7UA is stored in the memory element R7UA, with the result that car A is still ready to serve the up hall call from the 7th floor which has already been generated. In view of the fact that L8UA is prohibited, however, the up hall call HC8U of the 8th floor which might be generated cannot be served by car A any more.

For this reason, the service zone of car A, as shown in FIG. 2, comprises the upward direction at the 2nd to 7th floors and upward direction at the 9th floor.

The operation for allotting the hall call thud determined inserviceable to the succeeding car will be explained in detail below with reference to FIG. 12.

In the explanation of the circuit of FIG. 9, reference was made to the case in which the provisional service zone is from 2U to 9U for car A, from 10D to 6D for car B and from 5D to 2D fo car C. Under this condition, the explanation will be made below of the reason why the secondary provisional service zone is from 10D to 6D for car A, from 5D to 2D and 1U for car B and from 2U to 9U for car C.

The fact that car B is travelling down at the 10th floor in the case of FIG. 9 causes the signal 10D to be generated in the circuit of car B and transmitted to the circuit for car A (FIG. 9). Also, since the signal S10DA for the down travel from the 10th floor is generated in FIG. 9, the AND element A10DA4 in the circuit of FIG. 12 produces a "1" signal, which is applied through other elements as in the case of FIG. 9. In like manner, signals are generated by the circuits for cars B and C (which are not shown) which are travelling down at the 5th floor and up at the 2nd floor respectively. As a result, the secondary provisional service zone is determined to be from 10D to 6D for car A, from 5D to 2D for car B and from 2U to 9U for car C. In other words, the secondary provisional service zone of a given car coincides with the primary provisional service zone of an immediately leading car.

The signals representing these primary and secondary provisional service zones are applied to the OR elements O9UA8 and O2DA8 to O10DA8 and take the form of the signals LL1UA to LL9UA and LL2DA to LL10DA through the inhibit elements, which are adapted to be prohibited according to the conditions mentioned below.

These signals, as already explained, act in such a manner as to energize the hall call-allotting relays Ry1UA to Ry9UA and Ry2DA to Ry10DA through the circuit of FIG. 13. The prohibit signals LL1UA to LL9UA and LL2DA to LL10DA from the inhibit elements are signals produced as the result of deciding a service car in response to a hall call, as will be seen from FIG. 10, on the basis of the primary provisional service zone signals of another car involving the floor concerned. In this way, the hall call which has not been allotted to any car as yet can be allotted to a succeeding car.

It is desirable to indicate as early as possible the car thus allotted to the hall call on the landing of the service floor and to guide prospective passengers toward it. In addition, this facilitates the detection of the number of prospective passengers expected to get on the car, resulting in an improved accuracy of detection and forecasting.

Apart from the case of FIG. 16A where the hall waiting passenger detector is arranged on the landing of each floor, other modifications of the construction will be described with reference to FIGS. 16B, 16C and 16D.

Figure 16B:
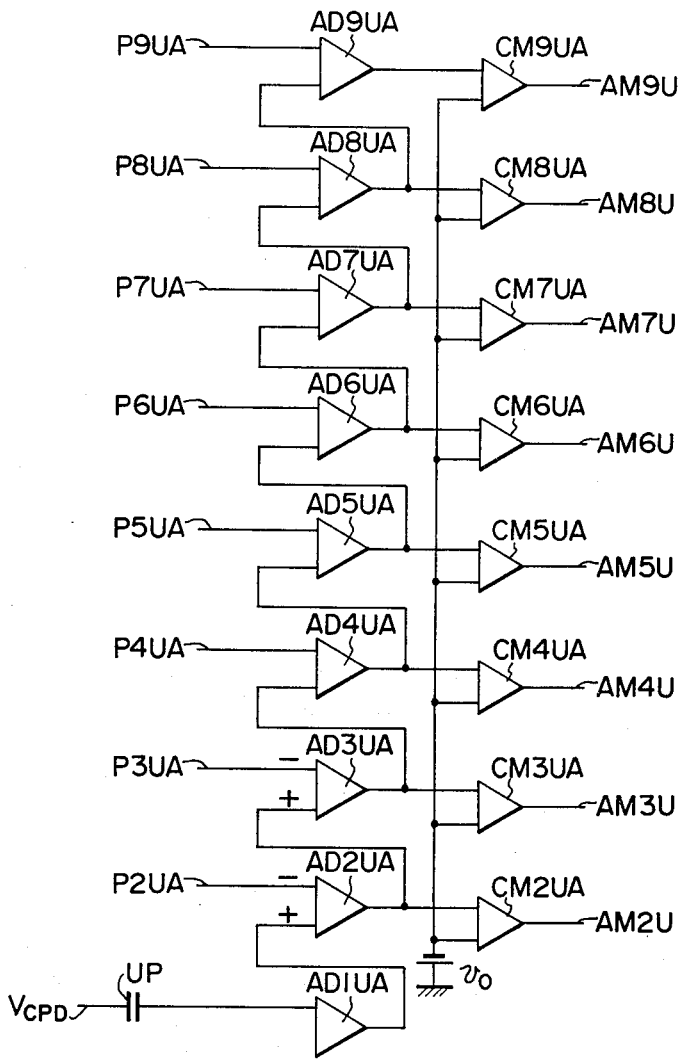

The most simple example shown in FIG. 16B constitutes a circuit for forecasting the number of in-cage passengers at each floor only on the basis of the present total number of in-cage passengers and the number of in-cage passengers for every destination floor, and the serviceability decision. This circuit does not include the outputs H1UA, H1UA, . . . H9UA of the hall waiting passenger number detectors for the respective floors unlike the circuit of FIG. 16A, and the operation thereof will be easily understood from the foregoing description.

The above-mentioned construction offers a very simple and economical apparatus. Especially, this is advantageous if employed during the morning rush hours or the like when a car filled to capacity at the dispatch floor (or the 1st floor) has less passengers according as it moves up.

Figure 16C:
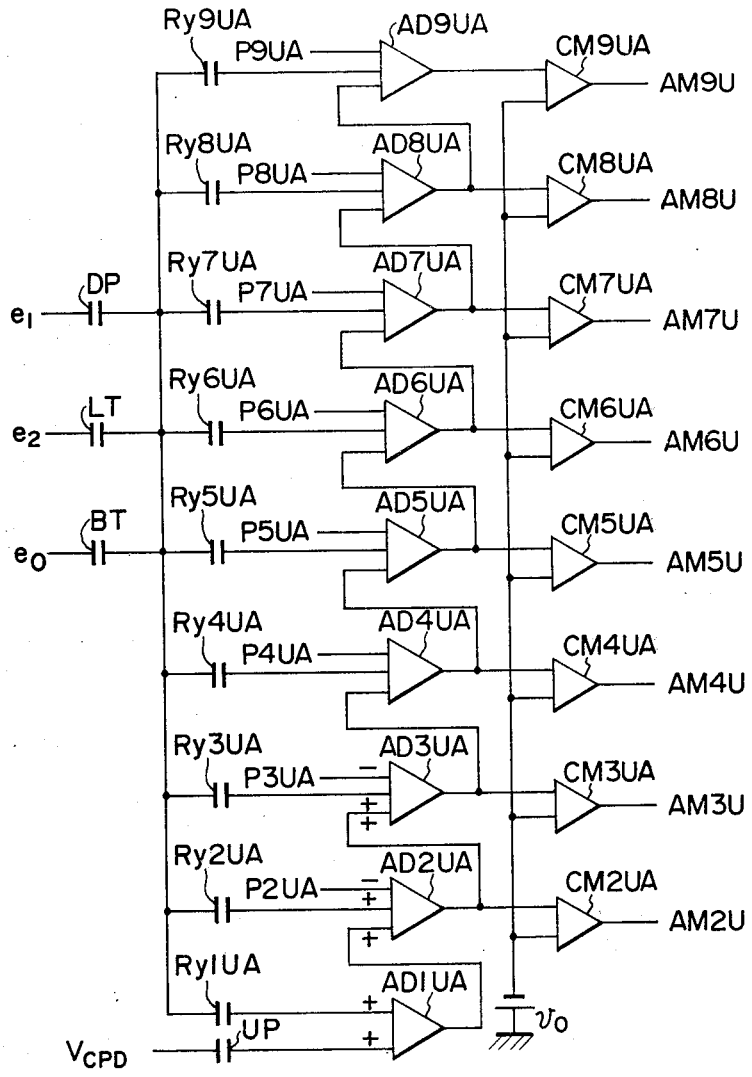

The circuit of FIG. 16C is characterized by the fact that a predetermined number is added to the number of in-cage passengers at the floor that has generated a hall call. In this embodiment, the predetermined number is added to the number of in-cage passenger uniformly at whichever floor a hall call is generated. And this predetermined number is changed three ways according to the traffic demand. In other words, when the traffic demand is normal, the contact BT is closed, so that the voltage $e_0$ (which represents the loading of one additional passenger) is applied to the adders AD1UA to AD9UA through the contacts Ry1UA to Ry9UA energized by hall calls. Of course, it is possible to add a greater weight to the floors where prospective passengers are greater in number than the others, depending on the nature and traffic demand of the building. When the contact DP is closed upon detection of the traffic demand for the evening rush hours, on the other hand, the voltage of, say, $e_1$ representing two persons taking of the car anew is applied to the adder corresponding to the floor generating the hall call. Further, the detection of the traffic demand for lunch recess causes the contact LT to be closed, whereupon the voltage representing, say, three persons are applied to the adder corresponding to the floor generating the hall call. It will be obvious from the drawing under consideration that the operation is the same for the number of in-cage passengers for every destination floor as in FIG. 16A.

Figure 16D:
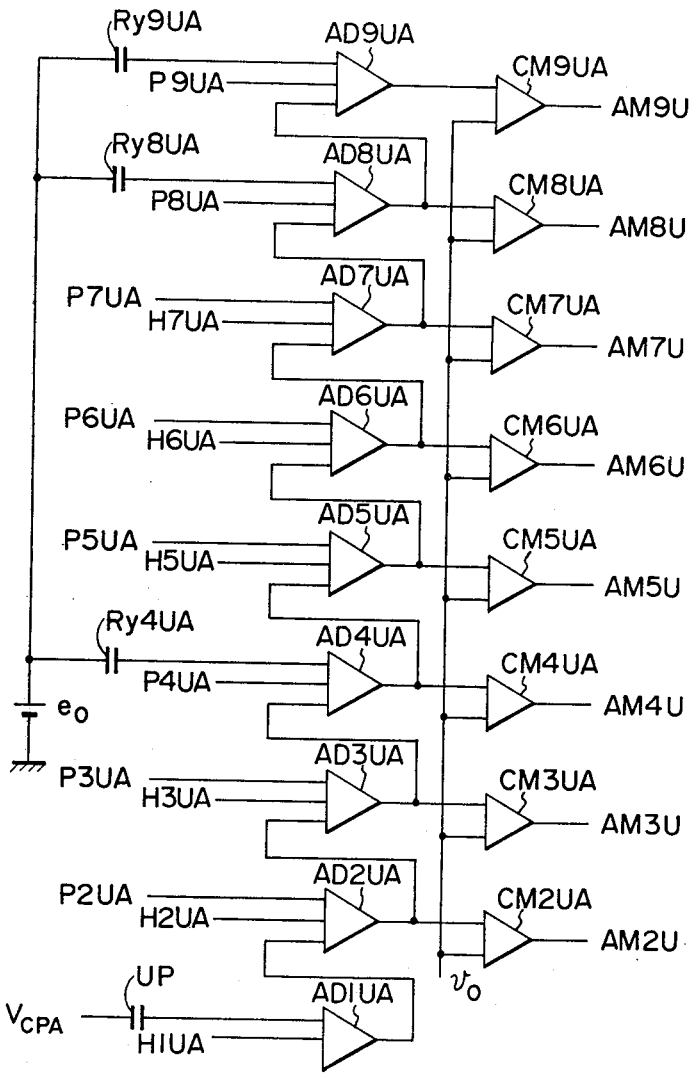

Finally, the circuit of FIG. 16D illustrate the most practical embodiment. In this embodiment, the hall waiting passenger number detectors are provided only at predetermined floors with comparatively high traffic demand depending on the pattern of occupancy of the building, while a predetermined value of the nunber of hall waiting passengers is applied to the other floors. In the example shown, detection signals are obtained at the reference or 1st floor H1UA, second floor H2UA, 3rd floor H3UA, 5th floor H5UA, 6th floor H6UA and 7th foor H7UA, whereas the landings of the 8th and 9th floors are not provided with any waiting passenger number detectors but impressed with the voltage setting $e_0$. This configuration consisting of a combination of the circuits of FIG. 16A and FIG. 16C permits an economical and accurate forcasting of the number of passengers. In this case, too, the voltage setting for the floors lacking the waiting passenger number detectors may be adjusted or differentiated as required according to changes in traffic demand.

The above-described method for hall call allotment according to the first embodiment does not take into accurate the waiting time spent before a hall call is served. In FIG. 2, for example, assume that a multiplicity of hall calls or cage calls are registered in car A whereas few are received by car C. An up hall call that may be generated at the 9th floor is allotted to car A. A long waiting time is required until such a hall is served, since car A must stop at many floors before arrival at the 9th floor for up travel. Car C, on the other hand, which has few service floors registered therein may arrive at the 9th floor for up travel earlier than car A. In spite of this, car C is not ready to serve the 9th floor up hall call, as it is not allotted to car C. So, the fact remains that the hall waiting passenger at the 9th floor for up travel must wait for car A, resulting in a long waiting time. Generation of such a long-waiting call will deteriorate the elevator service.

The second embodiment of the invention makes possible an improved elevator service by eliminating the long waiting required before a successful service of a hall call.

Specifically, the waiting time required until each car reaches leading floors is forecast, so that a car most suitable to serve each floor is selected at every moment. In other words, among the cars determined to be able to accomodate additional passengers on the basis of the in-cage passenger forecast in the preceding embodiment, a car with the shortest forecast waiting time is selected. Thus, a hall call generated at the floor is allotted to the selected car.

Figure 17:
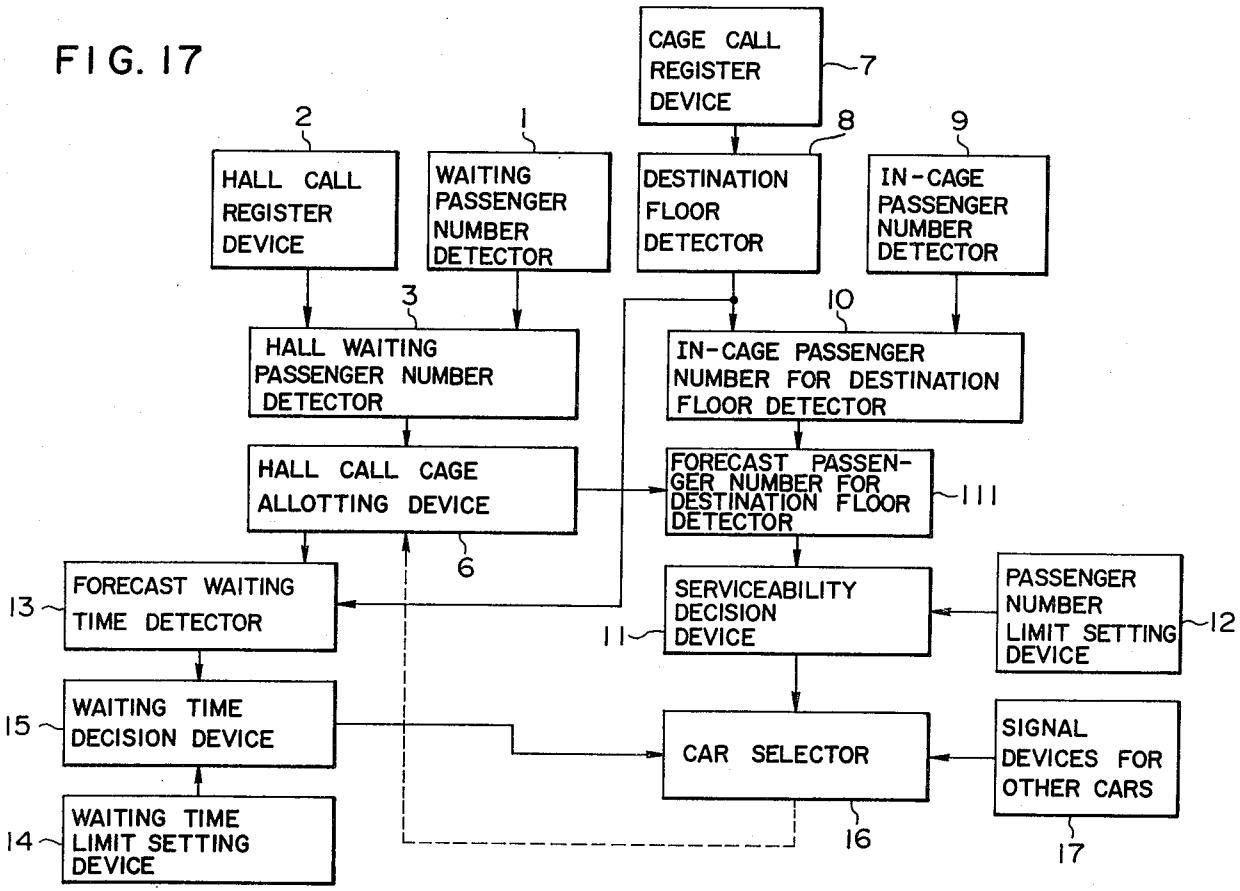
FIG. 17 is a diagram schematically showing the entire configuration of a second embodiment of the elevator group control utilizing the present invention.

An elevator control system according to this second embodiment will be described with reference to the block diagram of FIG. 17.

The number of hall waiting passengers for each floor generating a hall call is detected by the detector device 3 in response to the outputs from the hall call register device 2 and the waiting passenger number detector 1 provided at each floor. The number of in-cage passengers for every destination floor is detected by the detector device 10 in response to the outputs from the cage call register device 7 and the in-cage passenger number detector 9 provided for each car. The forecast-passenger-number-for-destination-floor detector 111 detects the forecast number of passengers for each of the leading floors on the basis of the number of hall waiting passengers at each of the floors generating hall calls that have already been allotted to the car involved by the allotting device 6, and on the basis of the number of passengers for every destination floor. The forecast number of passengers at each floor is compared in the serviceability decision device 11 with the passenger number limit obtained from the setting device 12, so that the serviceability decision device 11 produces a signal determining whether or not the car is able to accomodate additional passengers at respective floors. The device 13 for detecting the forecast waiting time for each floor, on the other hand, detects the waiting time required until the car reaches each floor on the basis of the number of service floors determined by the cage calls and the allotted hall calls, and the distance from the car to the particular floor. At the same time, the forecast waiting time decision device 15 decides whether or not the forecast waiting time required from the generation of a hall call until the arrival of the car at the allotted floor generating the hall call exceeds the waiting time limit set by the device 14. The car selector 16 picks up, of all the cars, the one which is both capable of accomodating additional passengers and shortest in the forecast waiting time, for each floor, in response to the outputs from the serviceability decision device 11, the forecast waiting time decision device 15 and the signal devices 17 for the other cars similar to the devices 11 and 15.

Now, assume that a hall call is generated at a given floor and that a car with the shown devices is selected for the floor, so that a signal shown by the dotted line is supplied from the car selector 16 to the allotting device 6. The allotting device 6 is energized thereby to detect that the hall call generated at the above-mentioned floor has been allotted to the car having the shown devices. The allotting device 6 requires the forecast passenger number detector 111 and the forecast waiting time detector 13 to serve the particular floor, while at the same time informing them of the number of hall waiting passengers.

The intended objects of the invention are thus attained by detecting the forecast number of in-cage passengers and selecting and allotting a hall call to a car which is capable of accommodating additional passengers and shortest in forecast waiting time.

More detailed description will be made below with reference to an actual example of the circuit.

The very circuits of FIGS. 14 to 16 may be used also in this example.

Figure 18:
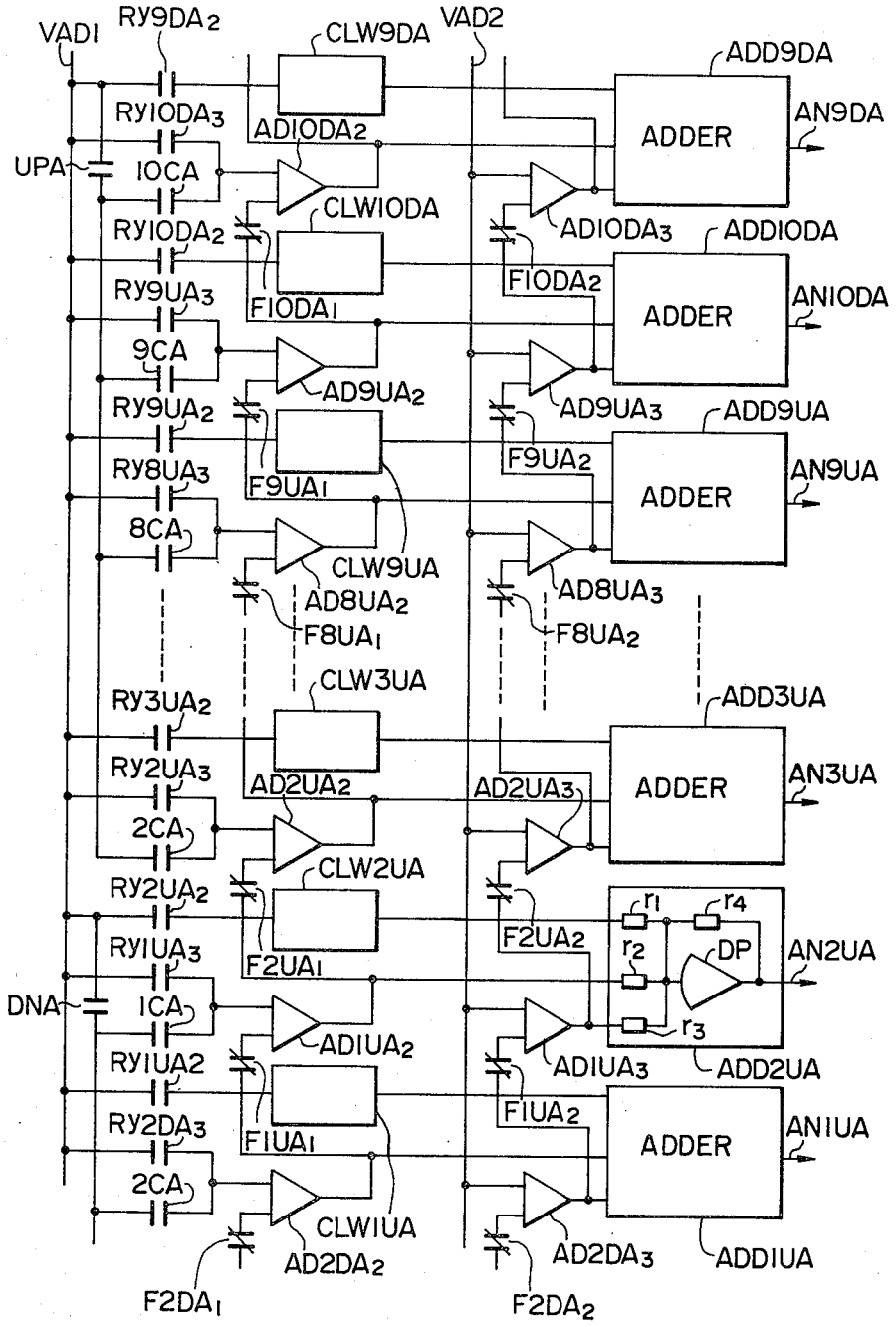
FIG. 18 shows a waiting time forecasting circuit.

The diagram of FIG. 18 shows a forecast waiting time detector circuit for detecting the forecast waiting time required until the car A reaches each floor for up travel. Similar circuits are required also for down travel of car A and for cars B and C. In the drawing under consideration, symbol VAD1 shows a set voltage corresponding to the time required for a car to stop a floor one time service, VAD2 a set voltage corresponding to the time required for a car to cover the length of one floor, symbols Ry1UA2 to Ry10DA2 and Ry1UA3 to Ry10DA3 contacts of the relays Ry1UA to Ry10DA respectively energized when car A has responded to the hall calls generated at the 1st to 10th floors, symbols 1CA to 10CA contacts energized upon generation of a cage call in car A, symbols AD1UA2 to AD10A2 and AD1UA3 to AD10DA3 adders, symbols CLW1UA to CLW10DA time counters, symbols F1UA1 to F10DA1 and F1UA2 to F10DA2 contacts turned off when car A is located at the 1st to 10th floors for up or down travel, and symbols ADD1UA to ADD10DA adders producing the forecast waiting time signals AN1UA to AN1-0DA for the respective floors.

As an example, let us consider a case where the contacts F1UA1 and F1UA2 are off due to the fact that car A is situated at the 1st floor for up travel. The set voltage VAD2 is applied to one of the input terminals of the adders AD2UA3 to AD10DA3 through AD-1UA3, F2UA2, AD2UA3, . . . AD8UA3, and so on. As a result, the adder AD1UA3 produces a voltage signal VAD2 corresponding to the time required for the car to cover the length of one floor. The adder AD2UA3, in response to the output voltage from the adder AD-1UA3 and the set voltage VAD2, produces a voltage signal corresponding to the time required for the car to cover two floors, namely, VAD2 multiplied by two. Similarly, the adders AD3UA3 to AD10DA3 produce voltage signals corresponding to the time required by the car for coverage of 3 to 10 floors respectively. In this way, the voltage signals corresponding to the time required for the car to travel from its present position to the respective floors are detected and applied to the adders ADD2UA to ADD9DA.

Consider another case in which a cage call is generated in car A for the 8th floor and at the same time a second floor up hall call is allotted. The contacts 8CA and Ry2UA2 and Ry2UA3 are on, and the set voltage VAD1 is applied through Ry2UA3, AD2UA2, F3UA1, AD3UA2, . . . F8UA1, and AD8UA2. The adder AD-2UA2 produces a voltage signal VAD1 indicating one service. Similar outputs are produced also by the adders AD3UA2 to AD7UA2. Also, the fact that the contact 8CA is closed causes the output voltage from the adder AD7UA2 and the set voltage VAD1 to be applied through the contact 8CA to the adder AD-8UA2. The adder AD8UA2 produces an output signal VAD1 × 2 representing two services, which output is applied through AD8UA2, F9UA1, AD9UA2 and so on. In this way, the adders AD2UA2 to AD7UA2 produce the voltage signal VAD1 corresponding to the time required for one service, whereas the subsequent adders including adder AD8UA2 produce signals VAD1 × 2 corresponding to the time required for two services, so that the outputs from the adders AD2UA2 to AD10UA2 are applied to the adders ADD1UA to ADD10DA respectively.

The adders ADD1UA to ADD10DA are for producing the forecast waiting time signals AN1UA to AN1-0DA required for a car to reach each floor by adding the signal voltages corresponding to the time required for the car to travel from the above-mentioned car positions to the respective floors and the signal voltages corresponding to the time spent by the car in staying at intermediate floors. Assume for example that it takes a car 10 seconds to stay and serve a call, and two seconds to travel the length of one floor, and that the voltages VAD1 and VAD2 are set at the corresponding levels. The forecast waiting time signal AN2UA is a voltage corresponding to two seconds, and the forecast waiting time signal AN3UA a voltage corresponding to 14 seconds (2 seconds × 2 + 10 seconds).

The voltages VAD1 and VAD2 may be set at appropriate levels not related to time instead of at predetermined levels as described above. In such a case, the outputs of the adders AD1UA2 to AD10DA2 and AD-1UA3 to AD10DA3 are rendered voltages corresponding to the number of times of car service at floors and the length between floors, respectively. Further, the time required for the service and coverage between floors is adjusted by adjusting the operational resistors $r_2$ to $r_4$ of the adders ADD1UA to ADD10DA (only the adder ADD2UA is shown in the drawing) as easily as the preceding case.

As to the floor where a hall call is generated, the time in call is also taken into consideration in detecting the forecast waiting time for such a floor. When an up hall call is generated at the 2nd floor as in the preceding case, the generating time of hall call is counted by the counter CLW2UA through VAD1, RyUA2, and CLW2UA and applied to the adder ADD2UA where it is added to the forecast waiting time.

As mentioned above, the forecast waiting time required until each car reaches each floor from the present position thereof is detected on the basis of the length to be covered and the number of floors to be served before reaching the particular floor.

Figure 19:
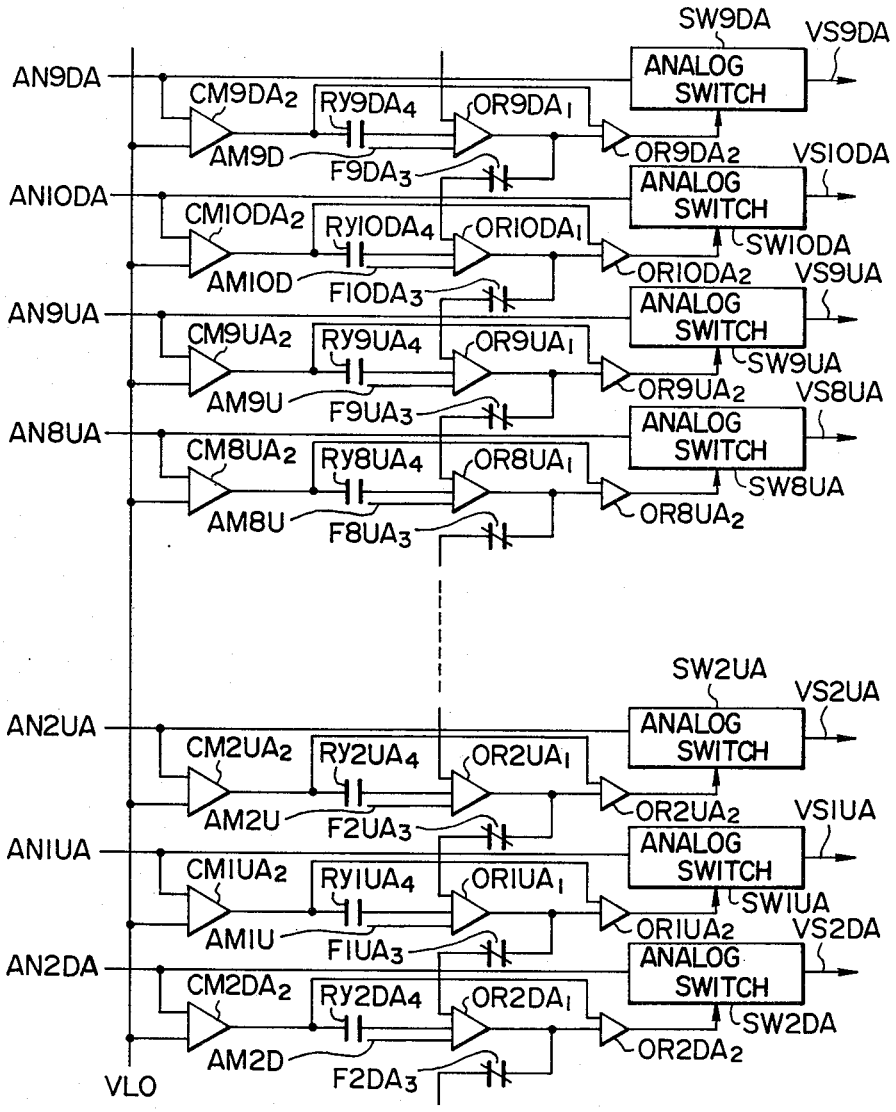
FIG. 19 shows the serviceability decision circuit.

The diagram of FIG. 19 shows a serviceability decision circuit for car A in up travel. Similar circuits are provided also for down travel of car A and travel in both directions for cars B and C. When the forecast waiting time signals AN1UA to AN10DA supplied from the circuit of FIG. 18 are lower than the reference voltage VLO corresponding to a predetermined waiting time and at the same time the forecast passenger number decision signals AM1UA to AM10DA supplied from the circuit of FIG. 16 indicate that there is still room for an additional passenger or passengers, then the serviceable signals VS1UA to VS10DA are generated, thereby deciding that car A is able to serve the respective floors. In the drawing, reference symbols CM1UA2 to CM10DA2 show comparators for producing a "0" output when the reference voltage VLO is higher than the other input thereto, symbols OR1UA1 to OR10DA1 and OR1UA2 to OR10DA2 "OR" elements, and SW1UA to SW10DA analog switches which are opened when the outputs of the OR elements OR-1UA2 to OR10DA2 are in the state of "1" respectively.

Assume that the forecast waiting time AN9UA for the 9th floor up travel is compared with the reference voltage VLO and that the signal representing the forecast waiting time AN9UA is lower than the reference voltage VLO. The output of the comparator CM9UA2 is "0", thereby deciding that the forecast waiting time AN9UA for the 9th floor up travel is shorter than the predetermined waiting time. The output of the comparator CM9UA2 is applied to the OR element OR9UA2 and the OR element OR9UA1 through the contact Ry9UA4 energized when a 9th floor up hall call is allotted to car A. The output of the OR element OR-9UA1 is also impressed with the forecast passenger number decision signal AM9U for the 9th floor up travel and the output from the OR element OR10DA1 for the 3rd floor up travel. Since there is room for additional passengers, the forecast passenger number decision signal is in the state of "0"; and assuming that the output of the OR element OR10DA1 is also in the state of "0", the outputs of both the OR element OR-9UA1 and OR element OR9UA2 are "0", thereby closing the analog switch SW9UA. Thus the analog switch SW9UA produces the forecast waiting time signal AN9UA in the form of the serviceable signal VS9UA indicating that ear A is ready to serve the 9th floor up call, and the waiting time of VS9UA (= AN-9UA) is detected.

When the forecast waiting time AN9UA exceeds the reference voltage VLO, on the other hand, the output of the comparator CM9UA2 becomes "1", and the analog switch SW9UA is opened through the OR element OR9UA2, thus preventing the forecast waiting time VS9UA from being produced. Also, when the forecast passenger number decision signal AM9U becomes "1", indicating an inserviciability, the analog switch SW9UA is similarly turned off, and at the same time the output of the OR element OR9UA1 is applied through the position relay contact F9UA3 to all the OR elements OR8UA1 to OR1UA1 (It is assumed that car A is located at the 1st floor) associated with the floor where car A is positioned, thereby cutting off all the analog switches SW9UA to SW1UA. As a result, it is decided that car A is not able to serve subsequently-generated up hall calls at the 9th floor, and none of the serviciable signals VS9UA to VS1UA are generated. In this way, the adverse situation is prevented where the car is filled to capacity and prospective passengers are left unloaded by serving a hall call or hall calls infront of the allotted 9th floor up hall call after generation of an inserviceability signal. Further, in the event that the forecast waiting time signal AN9UA exceeds the reference voltage VLO when the contact Ry9UA4 is closed with the 9th floor up hall call allotted, the outputs in the state of "1" are produced from the OR elements OR9UA1 to OR1UA1 through CM9UA2, Ry9UA4, OR9UA1, F9UA3, OR8UA1, . . . F2UA3 and OR-1UA1. Therefore, the analog switches SW9UA, SW1UA are similarly turned off. Obviously, this is intended to prevent the waiting time for the 9th floor up service from being lengthened due to the delayed arrival of car A by disregarding any hall calls which may be generated subsequently before arrival at the 9th floor.

Thus, when it is decided that a floor is able to be served within the predetermined forecast waiting time and that the car has room for additional passengers, the serviceable signals VS1UA to VS10DA are generated.

Figure 20:
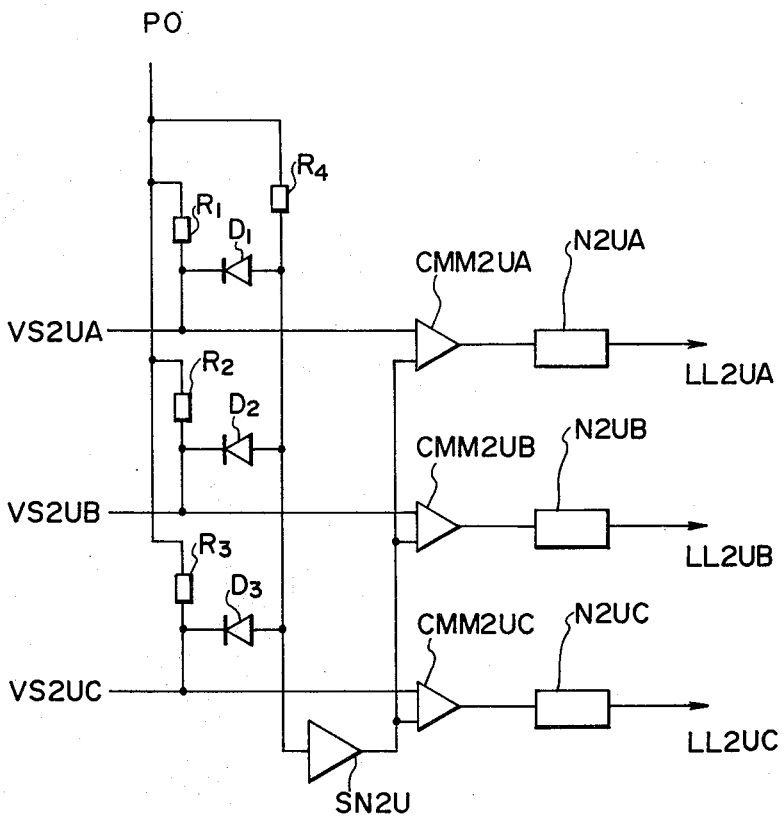
FIG. 20 shows a circuit for selecting a car involving a minimum waiting time.

The diagram of FIG. 20 shows a circuit for selecting a car involving a minimum forecast waiting time and concerns up service at the 2nd floor. A similar circuit is provided for each floor for each direction of travel. In response to the 2nd floor up serviceable signals VS2UA to VS2UC from the serviceability decision circuits for cars A to C shown in FIG. 19, the circuit under consideration selects a serviceable car with minimum forecast waiting time and produces car selection signals LL2UA to LL2UC. In the drawing, reference symbols R1 to R4 show resistors (each of R1 to R3 being larger than R4), symbols D1 to D3 diodes, symbols SN2U inverters, symbols CMM2UA to CMM2UC comparators, and symbols N2UA to N2UC "NOT" elements. The operation of this minimum waiting time car selector circuit is well known as it is disclosed in Japanese Patent Publication No. 11938/1972 and will be briefly described below.

Assume that all of the cars A to C are able to serve the second floor for up travel and that the serviceable signals VS2UA to VS2UC are 1V, 2V and 3V respectively. Current flows from $P_0$ to R4 to D1 to VS2UA, so that only the diode D1 conducts. (It is assumed that the forward voltage drop in the diode is 0.5V.) The potential at the common anode of the diodes is therefore 1.5V. The inverter produces an output voltage of −1.5 V. The output voltage of −1.5V from the inverter SN2U and the serviceable signals VS2UA to VS2UC of 1V, 2V and 3V respectively are applied to the comparators CMM2UA to CMM2UC, resulting in the voltages of −0.5V, 0.5V and 1.5V. In other words, only the comparator CMM2UA produces a "0" signal. These signals are applied to the inputs of the NOT elements N2UA to N2UC, so that the car selection signal LL2UA takes the form of "1" while the other car selection signals LL2UB and LL2UC are in the state of "0", making it possible to select and detect a car with a minimum forecast waiting time of all the cars able to serve the particular floor.

On the other hand, when, say, the analog switch SW2UA in FIG. 19 is energized to open the circuit, the source voltage is applied to the cathode of the diode D1. This prevents an erroneous operation of the circuit and enables car B or C to be selected.

A hall call generated is allotted to the car selected as above. In other words, a car most suitable for serving each floor is selected before a hall call is generated. Thus preparation is always made for allotment of the car most suitable for service.

Reference is made again to FIG. 13 to which the car selection signals LL1UA to LL10DA for car A for different directions are applied from the circuit similar to that of FIG. 20. In view of the fact that the contacts HC1U to HC10D are closed due to the generation of hall calls and that the car selection signals LL1UA to LL10DA are generated, relays Ry1UA to Ry10DA are driven and held by the amplifier elements R1UA to R10DA. The driving of the relays Ry1UA to Ry10DA, in turn, leads to the decision that car A serve the floors associated with the hall calls.

Figure 21:
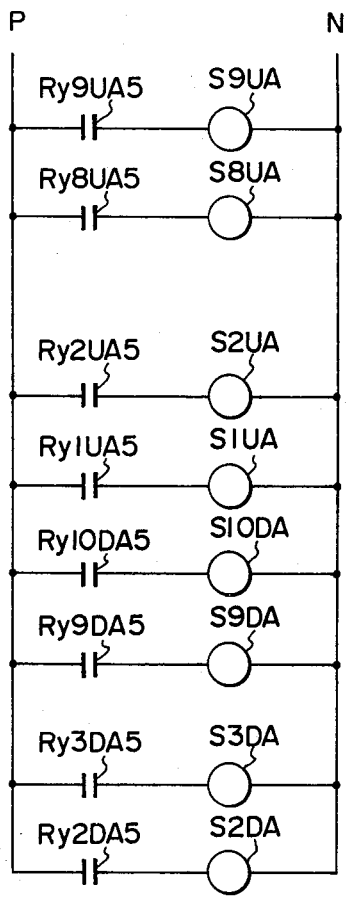
FIG. 21 shows a guiding and indication circuit.

A service car indicator circuit shown in FIG. 21 is provided for each car. In the drawing, reference symbols S1UA to S10DA show indicaion lamps arranged on or in the vicinity of the landing for car A at the respective floors. If the indication lamps S1UA to S10DA are turned on, it informs the hall waiting passengers of the expected service by car A. By the way, Ry1UA5 to Ry10DA5 show contacts of the relay Ry1UA to Ry10DA shown in FIG. 13.

When car A responds to a second floor up hall call and the relay Ry2UA is energized, for instance, the relay contact Ry2UA5 is closed thereby to turn on the indicaion lamp S2UA, thus making it possible to inform early the hall waiting passengers of the expected service of car A. As a result, the hall waiting passengers are able to spend their time until the arrival of car A on or in the vicinity of the landing thereof without watching the move of the other cars, thereby enabling them to take the opportunity to take the car A without fail.

As wll be seen from the foregoing detailed description of the elevator control system according to two embodiments of the invention, the forecast number of passengers at each floor is detected on the basis of the number of hall waiting passengers and the number of in-cage passengers in the invented system, and accordingly it is decided whether or not a car has room for additional passengers for each floor. Thus a premature filled up state or the situation where passengers are left unloaded is prevented, and no reallotment of a hall call after generation thereof occurs, thereby improving the reliability of the indication lamps. Further, the forecast waiting time required till each car arrives at each floor is detected at each moment on the basis of the number of intermediate floors to be served and the length between floors and is taken into consideration as an element in allotting a hall call, resulting in the additional advantage that the most suitable car involving the shortest waiting time is selected against a given hall call, contributing to the realization of a highly efficient elevator control system offering the quickest elevator service. In addition, once a hall call is allotted, the lapse of time since the generation thereof is another factor taken into consideration by the invention, so that the waiting time is prevented from being lengthened more than a predetermined measure, thus eliminating any case of protracted waiting, while at the same time achieving a substantially uniform waiting time for all the calls.

In the above-mentioned first and second embodiments, the car determined to serve a hall call is rarely filled to capacity before the car arrival at the floor generating the hall call, and therefore it is almost no need to change the service car, thereby permitting an improved service to prospective passengers.

However, the fact that a service car is determined early after generation of a hall call may lead to a case of delayed service to the hall call or filled up state before successful service thereto if the number of passengers is increased within a subsequent short period of time. Also, prospective passengers may have to wait a long time before their hall call is served, due to intentional wrong operation of buttons by (prospective) passengers.

Such an adverse situation is eliminated by what might be called a feedback method employed in addition to the above-mentioned determination of a service car. In other words, the waiting time associated with the hall call determined to be taken charge of is forecast, and when the forecast waiting time exceeds a predetermined value, the operation of the service car is promoted thereby to prevent the long waiting time before the service to the hall call.

Figure 22A:
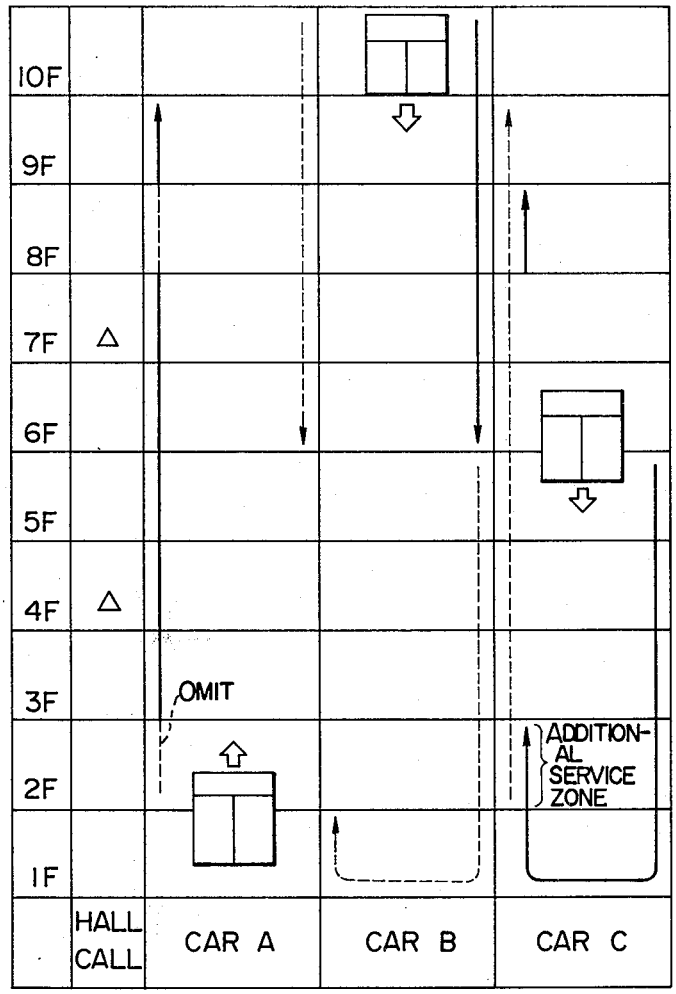
FIGS. 22A to 22C are diagrams for explaining a second embodiment of the invention.
Figure 22B:
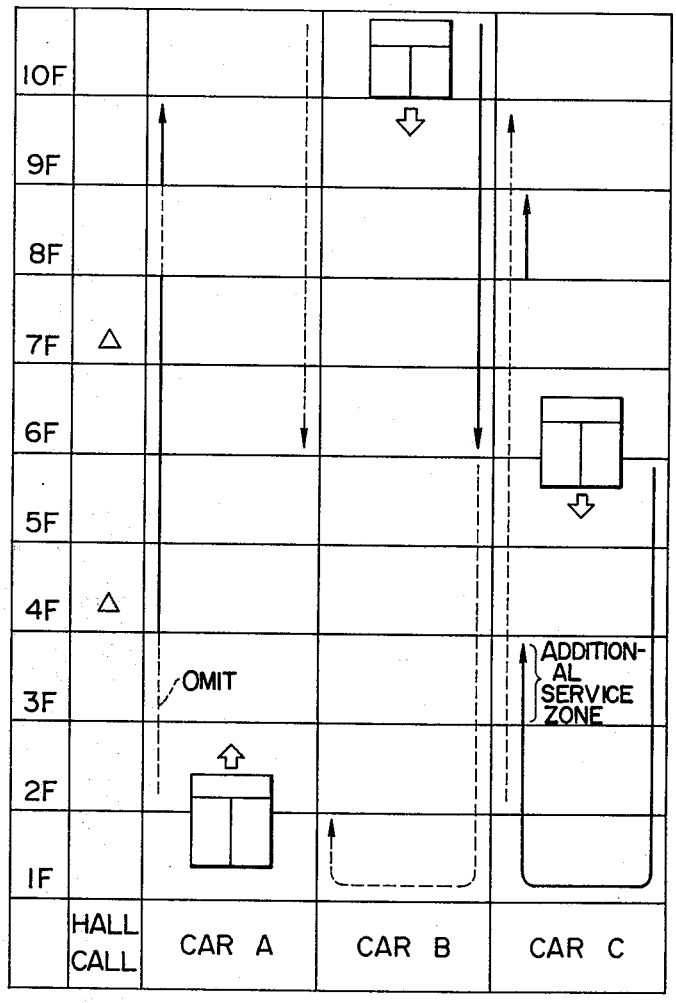
Figure 22C:
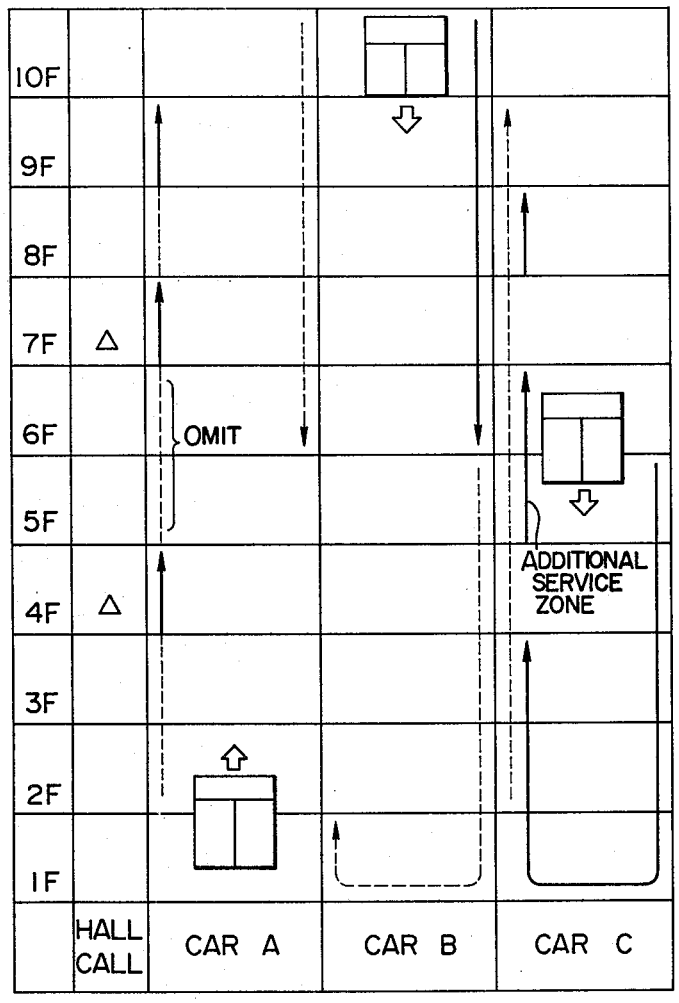

The above-mentioned novel method will be described with reference to an example as applied to the first embodiment shown in FIG. 2. Assume that the sum of the time elapsed after generation of the 7th floor up hall call and the time necessary for being served thereafter, i.e. the forecast waiting time exceeds 60 seconds. One example that may be employed to promote the operation of car A under this condition is to shorten the already-mentioned service zone. In other words, the 2nd floor up service is cut off from the service zone of car A shown in FIG. 22A. By so doing, the service zone of car A consists of only up hall calls generated at the 3rd and higher floors, thus provisionally advancing the position of car A by one floor. Next, in the event that the forecast waiting time before service to the 7th floor hall call exceeds 70 seconds, car A is advanced by one more floor by cutting off the 3rd floor up service from the service zone thereof. The resulting service zone of car A includes the 4th to 7th floors and 9th floors for up travel. Further, in the case where the forecast waiting time associated with the 7th floor up hall call exceeds 80 seconds, subsequent hall calls that may be generated at the 7th or lower floor are not accepted. Now, the already-allotted 4th and 7th floor up service are all the hall calls included in the service zone of car A as shown in FIG. 22C.

In this manner of control, the 7th floor up hall call is served within a shorter time than the forecast waiting time.

Calls generated at the floors cut off from the service zone of car A, on the other hand, must be allotted to any other cars. In the above description, the 8th floor up call was cut off for the reason of passenger number limit and then the 2nd, 3rd and also 5th and 6th floors were eliminated due to the long waiting time associated therewith. Such floors are added to the service zone of car C succeeding car A in the manner described with reference to the first embodiment.

In adding the service zone, what might be called a secondary provisional service zone is determined for each car. In FIGS. 22A to 22C where the cars are running in the order of A to C to B to A, the provisional service zone of each car is defined as the secondary provisional service zone of a succeeding car as shown by dashed arrows in FIGS. 22A to 22C. The calls which do not belong to the service zone of any car such as the up hall calls at the 8th, 2nd, 3rd, 5th and 6th floors are allotted to the other cars according to the principle of secondary provisional service zones. Since the hall calls cut off from service zone of car A are all included in the secondary provisional service zone of car C, they are added to the service zone of car C for service thereby. Processes of such rearrangement of service zones are also illustrated in FIGS. 22A to 22C.

Even though the embodiment outlined above for promoting the car operation is concerned with the cutting off of the service zone, different methods for promotion of car travel are naturally employed for different types of employment of service zones or different methods of allotment where no service zone is used. Further, even an already-allotted hall call may be cancelled depending on the length of the waiting time.

An actual example of car position promotion will be described below with reference to FIGS. 23 to 25.

Figure 23A:
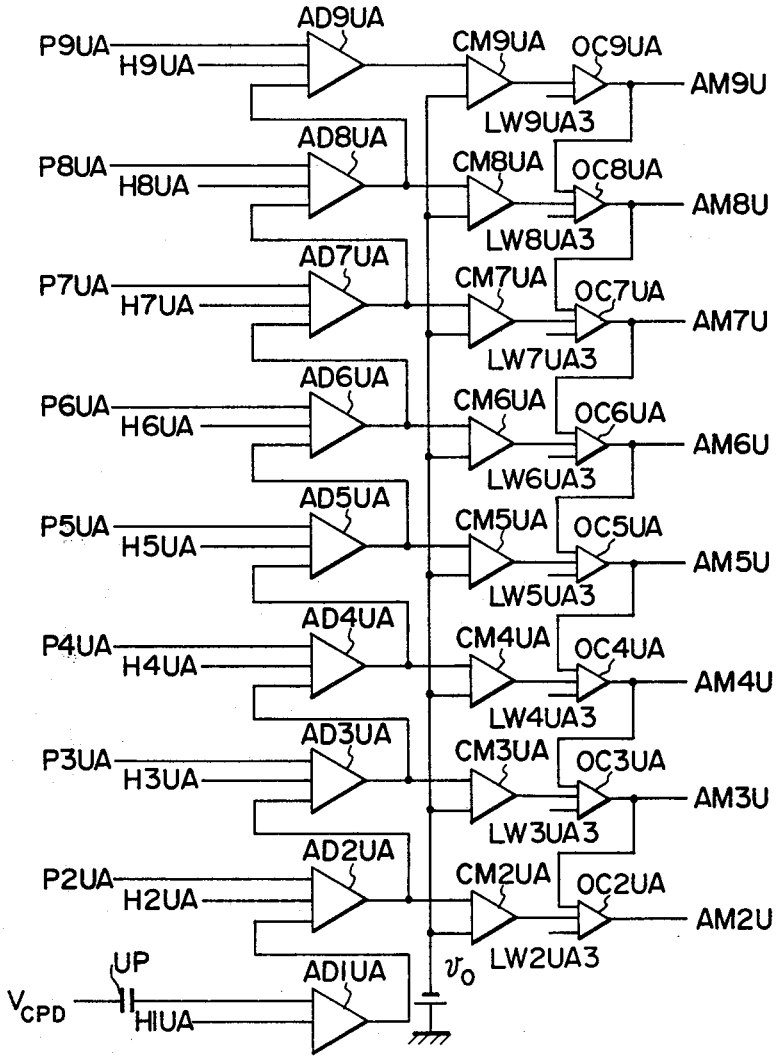
FIGS. 23A and 23B shows the serviceability decision circuit.
Figure 23B:
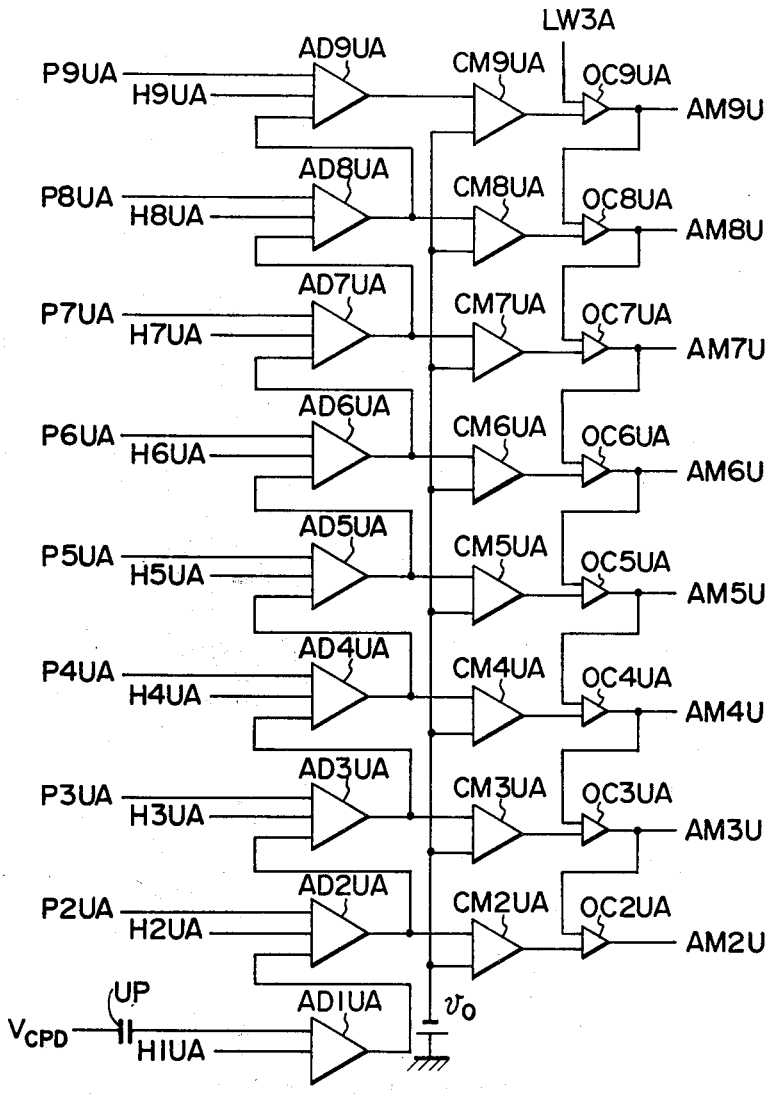

The diagram of FIGS. 23A and 23B show a serviceability decision circuit including the circuit for forecasting the number of in-cage passengers at each floor described with reference to FIGS. 16A to 16D and a circuit for producing a signal for cutting off the service zone when the number of in-cage passengers exceeds a predetermined number or when a predetermined length of waiting time is exceeded, as related only to up travel of car A.

Figure 24:
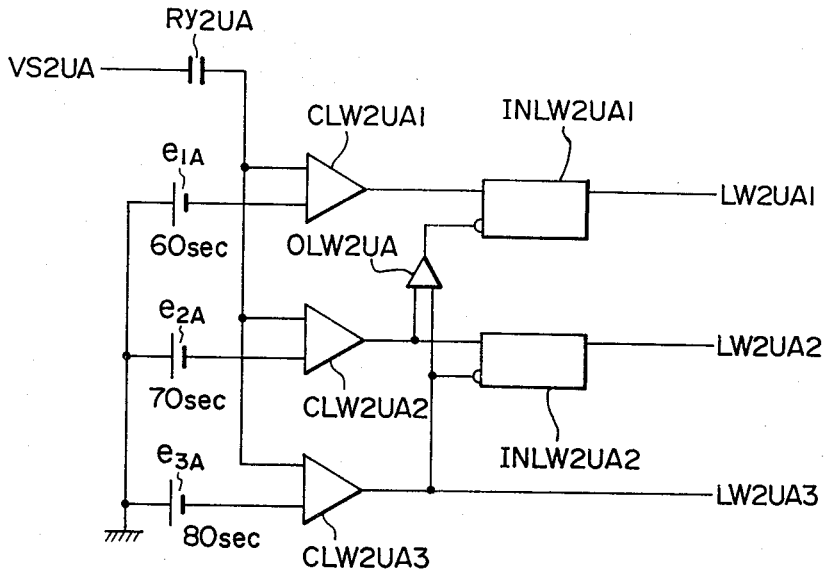
FIG. 24 and FIGS. 25A and 25B show a car promotional signal generator circuit.

The circuit of FIG. 24 is for producing a promotional signal to be applied to the car concerned depending on the result of the forecasting of the waiting time required before service of hall calls as explained with reference to FIGS. 18 and 19. A circuit similar to the one under consideration, which handles only the 2nd floor up service, is required for each floor for each car for each direction of car travel. The forecast waiting time associated with a service floor, for instance, the forecast waiting time VS2UA for the 2nd floor up service, obtained from the circuit of FIG. 19 is applied as one input to the comparators CLW2UA to CLW2UA3 through the service relay contact R*y*2UA.

The reference voltages $e_{1A}$, $e_{2A}$ and $e_{3A}$ corresponding to, say, 60, 70, 80 seconds are applied to one input of the comparators CLW2UA1 to CLW2UA3 respectively. As a result, these comparators produce the outputs LW2UA1 to LW2UA3 when the forecast waiting time exceed 60, 70 and 80 seconds respectively. The outputs of the comparators are so related to each other that an output of a higher level inhibits an output or outputs of a lower level through the OR element OLW-2UA, and the inhibit elements INLW2UA1 and INL-W2UA2.

The signals LW2UA1 to LW2UA3 thus obtained are used for promoting the operation of car A.

Figure 25A:
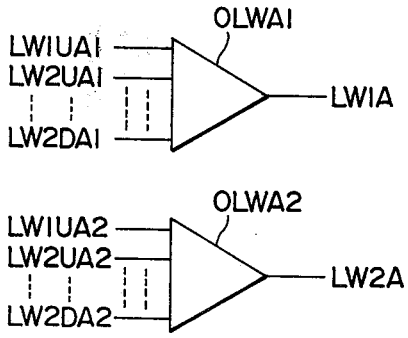

Part of these outputs, namely, the promotional signals up to the second stage with the last numerical suffix of 1 and 2 are applied to the OR elements OLWA1 and OLWA2 for taking a logical sum as shown in FIG. 25A, thus producing the promotional signals LW1A and LW2A for the first and second stages respectively.

These first- and second-stage promotional signals LW1A and LW2A are applied to OR elements OEA1 and OEA2 of FIG. 8 respectively as one input thereto for producing a one-floor promotional (or skip-over) signal E1A and a two-floor promotional (or skip-over) signal E2A respectively. In other words, when it is forecast that a hall call allotted to a car will require longer than 60 seconds before being served, the car skips over one floor; while it skips over two floors when the forecasting is that it takes more than 70 seconds until the hall call is served. In this way, the operation of the service cars is promoted thereby to offer service to prospective passengers at an earlier time than forecast.

In the event that the forecast time exceeds 80 seconds, the signals LW2UA3 to LW9UA3 generated in the circuit of FIG. 24 are applied to one input of the OR elements OC2UA to OC9UA of FIG. 23A respectively, whereupon these component elements are acted upon to cut off that entire portion of the service zone of the service car which otherwise might be served by the car before arrival thereof at the floor generating the hall call involving the long waiting time.

An actual example of such operation will be explained below with reference to FIGS. 22A to 22C.

Assume that it is decided that the forecast waiting time of a 7th floor hall call exceeds 60 seconds by the circuit of FIG. 24. The signal LW7UA1 is generated in the circuit of FIG. 24 for the 7th floor up call for car A, and applied to the OR element OLWA1 of FIG. 25A thereby to produce the promotional signal LW1A of the first stage. This signal is applied to the OR element OEA1 in FIG. 8, which produces the one-floor skip-over signal E1A, while at the same time eliminating the signal EOA. In FIG. 9, the application of signal E1A in the absence of the signal EOA causes the AND element A2UA1, which has thus far produced an output in response to the second floor position signal F2UA and the signal EOA, to stop producing the output signal. Instead, the not-shown AND element A3UA2 for the 3rd floor circuit produces an output. As a result, car A is advanced in provisional position and no longer ready to serve an up hall call from the 2nd floor that may be generated. This is equal to say that the 2nd floor up service is removed from the service zone of car A formed by the circuit of FIG. 9, resulting in the service zone as shown in FIG. 22A.

In like manner, when the forecast waiting time of a 7th floor hall call exceeds 70 seconds, the promotional signal of the second stage causes the two-floor skip-over command signal E2A to be produced, while at the same time eliminating the signal E1A. As shown in FIG. 22B, therefore, the service zone of car A is further lessened, thus enabling car A to serve the 7th floor up hall call within a shorter time than the forecast time.

Figure 25B:
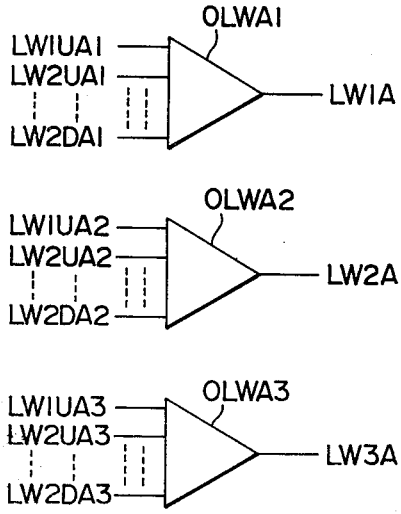

In the case of the forecast waiting time of the 7th floor hall call being more than 80 seconds, the 3rd-stage promotional signal LW7UA3 is produced in the circuit of FIG. 24. The OR element OC6UA in FIG. 23A is impressed with an input, which is transmitted through OC5UA, OC4UA, . . . OC2UA, thereby producing the inserviceability signals AM6U, AM5U, . . . AM2U for up calls of the 2nd and lower floors. Turning back to FIG. 9, the inhibit elements IN6UA3, IN5UA3, . . . IN2UA3 are inhibited, thus cutting off the service zone signals L6UA, L5UA to L2UA. As a result, in the same manner as described already, the service by car A to the hall calls of the 6th to 2nd floors other than the hall call HC4U already allotted is prohibited. In other words, the service zone of car A is limited to the already-allotted calls as shown in FIG. 22C, thus making it possible to offer quick service to the 4th- and 7th-floor hall calls. In the case where the circuits of FIG. 23B and FIG. 25B are employed in place of those of FIG. 23A and FIG. 25A, a hall call involving the forecast waiting time of more than 80 seconds is served by prohibiting the service allotment to all the other hall calls. In other words, the 3rd-stage promotional signal LW3A in FIG. 23B produces the inserviceability signals AM9U to AM2U for all the other floors. In this case, the 9th floor up service by car A in FIG. 22C is transferred to car C at the same time.

Figure 26:
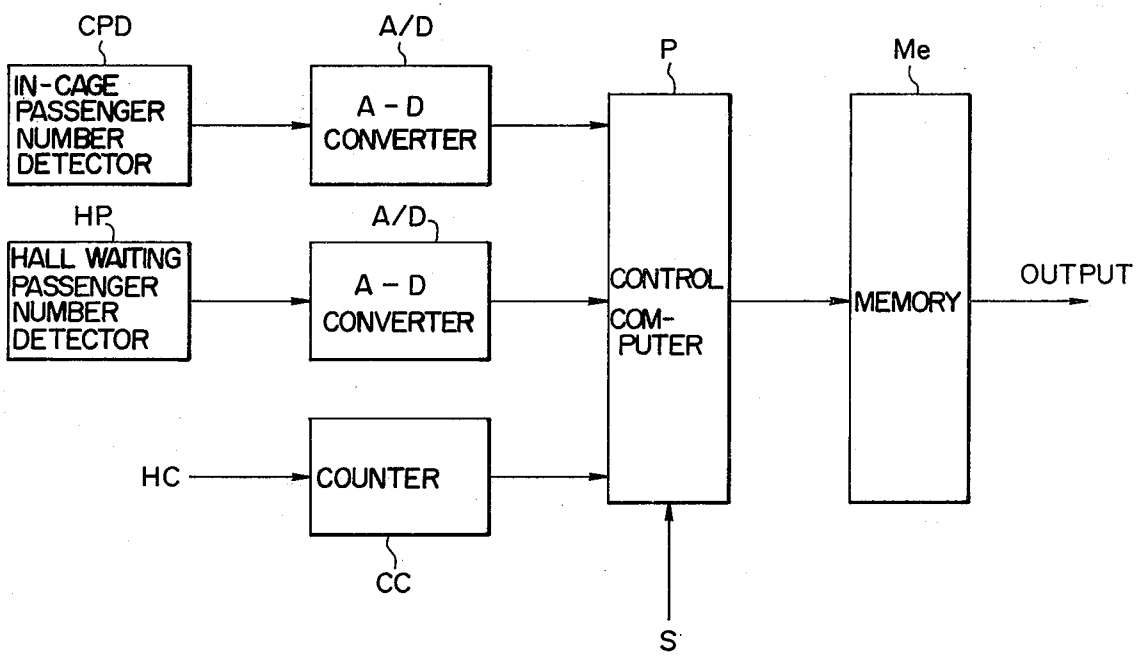
FIG. 26 is a schematic diagram showing the configuration of an example of a digital processing system.

The diagram of FIG. 26 schematically illustrates an embodiment for digitally processing the operation of the circuits of FIGS. 13, 16, 17 and 18. The outputs from the in-cage passenger number detector CPD and the hall waiting passenger number detector HP are converted into digital signals by the analog-digital converter A/D and applied in the form of digital signals to the processor P. The processor P, which may be a single-purpose processor, alternatively takes the form of a multi-purpose control computer in the embodiment under consideration by way of explanation. The hall call signal HC is applied to the counter CC where the lapse of time after generation of the hall call is calculated, and the result of calculation is applied to the control computer. Symbol S shows the other various signals including car position signals, cage call signals and the like. These signals are processed by the computer on the principle already mentioned with reference to the analog system. Such a processing operation is easily performed by the control computer, the only additional requirement being computer software, namely, the programming. Therefore, no detailed description thereof will be made here. Incidentally, symbol M shows a memory.

What is claimed is:

1. In an elevator control system comprising a plurality of cars for serving a multiplicity of floors, hall call register means provided at each floor landing, cage call register means mounted in each cage and means for detecting the total number of in-cage passengers in each car; the improvement further comprising means for forecasting the number of passengers for every destination floor by allotting the detected number of in-cage passenger to the cage calls, and means for forecasting the number of in-cage passengers at each floor by subtracting sequentially said number of in-cage passengers for destination floor from said detected total number of in-cage passengers.

2. An elevator control system according to claim 1, further comprising means for setting the number of hall waiting passengers at each floor, and means for sequentially adding said number of hall waiting passengers to said forecast number of in-cage passengers for each floor generating a hall call.

3. An elevator control system according to claim 2, in which said means for setting the number of hall waiting passengers at each floor includes a plurality of passenger number setting units having different settings, means for detecting traffic demand, and means for switching said plurality of passenger number setting units in response to the output from said means for detecting traffic demand.

4. An elevator control system according to claim 1, further comprising means provided at each floor for detecting the number of hall waiting passengers at said each floor, and means for sequentially adding the detected number of hall waiting passengers at each floor to said forecast number of in-cage passengers at said each floor generating a hall call.

5. An elevator control system according to claim 1, further comprising means provided at least a specified floor for detecting the number of hall waiting passengers at said specified floor, means for setting the number of hall waiting passengers at each of the floors other than said specified floor, means for sequentially adding the number of hall waiting passengers detected at said specified floor generating a hall call to the forecast number of hall waiting passengers for said specified floor, and means for adding sequentially the number of hall waiting passengers set by said hall waiting passenger number setting means for said other than specified floors generating a hall call, to the forecast number of incage passengers at said other than specified floors.

6. An elevator control system according to claim 1, further comprising means for setting an incage passenger number limit, and means for detecting the floors where each of said cars has room for additional passengers, by comparing said forecast number of in-cage passengers with said passenger number limit.

7. An elevator control system according to claim 1, further comprising means for forecasting the waiting time required until each car reaches each floor.

8. An elevator control system according to claim 7, further comprising means for selecting a car involving the shortest forecast waiting time by comparing said forecast waiting times of the respective cars with each other, for each floor.

9. An elevator control system according to claim 8, further comprising means for allotting to said selected car a hall call that is generated.

10. An elevator control system according to claim 6, further comprising means for forecasting the waiting time required until each car reaches each floor, and means for selecting a car having room for additional passengers and involving the shortest waiting time by comparing the forecast waiting times of the cars having room for additional passengers with each other, for each floor.

11. An elevator control system according to claim 7, further comprising means for determining and allotting a service car to a hall call generated, means for detecting the time that has elapsed after the generation of said hall call, means for forecasting the total waiting time before service to said hall call, by adding said time that has elapsed after the generation of said hall call to said forecast waiting time required before service by said allotted car, means for setting a limit of said forecast total waiting time, and means for preventing said allotted car from serving another hall call when said forecast total waiting time exceeds said limit.

12. An elevator control system according to claim 7, further comprising means for determining and allotting a service car to a hall call generated, means for detecting the time that has elapsed after the generation of said hall call, means for forecasting the total waiting time before service to said hall call, by adding said time that has elapsed after the generation of said hall call to said forecast waiting time required before service by said allotted car, means for setting a limit of said forecast total waiting time, and means for promoting the operation of said allotted car when said forecast total waiting time exceeds said limit.

13. An elevator control system according to claim 6, further comprising means for allotting a hall call generated at said floors to said car determined to have room for additional passengers.

14. In an elevator control system according to claim 6 comprising means for setting the service zone of each car on the basis of the relative positions of said cars, and means for allotting a generated hall call to a car the service zone of which includes the floor generating said hall call; the improvement further comprising means for eliminating from said service zone of each car those floors at which it has been decided that said car has no room for accomodating additional passengers.

15. An elevator control system according to claim 14, further comprising means for setting a secondary provisional service zone in addition to said service zone for each car, and means for adding said eliminated floors to the service zone of a car having the secondary provisional service zone including said eliminated floors.

16. An elevator control system according to claim 10, further comprising means for allotting a generated hall call to said selected car.

* * * * *